US007506830B2

(12) United States Patent
Naka et al.

(10) Patent No.: US 7,506,830 B2
(45) Date of Patent: Mar. 24, 2009

(54) APPARATUS FOR MODIFYING SURFACES OF TONER PARTICLES

(75) Inventors: Takeshi Naka, Susono (JP); Osamu Tamura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/035,785

(22) Filed: Feb. 22, 2008

(65) Prior Publication Data

US 2008/0149535 A1 Jun. 26, 2008

Related U.S. Application Data

(62) Division of application No. 11/017,948, filed on Dec. 22, 2004, now Pat. No. 7,358,024.

(30) Foreign Application Priority Data

Dec. 26, 2003 (JP) ..... 2003-434185

(51) Int. Cl.
*B02C 23/08* (2006.01)
*B02C 13/09* (2006.01)

(52) U.S. Cl. ..... 241/79.1; 241/189.1

(58) Field of Classification Search ..... 241/79.1, 241/189.1

See application file for complete search history.

(56) References Cited

U.S. PATENT DOCUMENTS

| | | | | |
|---|---|---|---|---|
| 5,482,808 | A | 1/1996 | Kondo et al. | |
| 2002/0092938 | A1 * | 7/2002 | Huang et al. | 241/19 |

FOREIGN PATENT DOCUMENTS

| | | | |
|---|---|---|---|
| EP | 1 530 099 | A2 | 5/2005 |
| JP | 9-85741 | A | 3/1997 |
| JP | 2000-29241 | A | 1/2000 |
| JP | 2001-259451 | A | 9/2001 |
| JP | 2002-233787 | A | 8/2002 |
| JP | 2003-103187 | A | 4/2003 |
| JP | 2003-262981 | A | 9/2003 |

* cited by examiner

*Primary Examiner*—Faye Francis
(74) *Attorney, Agent, or Firm*—Fitzpatrick, Cella, Harper & Scinto

(57) ABSTRACT

In a toner production process having at least a kneading step, a pulverization step and the step of simultaneously carrying out a surface modification step and a classification step to obtain toner particles, the surface modification and the classification are simultaneously carried out using a batch-wise surface modifying apparatus having at least a cylindrical main-body casing, a classifying rotor, a surface modifying means having a dispersing rotor and a liner. The positional relationship between the dispersing rotor and the liner is set in an appropriate specific state so that toner particles having a narrow particle size distribution with less fine powder and having a high sphericity can be obtained with a good efficiency.

3 Claims, 11 Drawing Sheets

APPARATUS FOR MODIFYING SURFACES OF TONER PARTICLES

This application is a division of application Ser. No. 11/017,948, filed Dec. 22, 2004, now U.S. Pat. No. 7,358,024 which is incorporated herein by reference.

BACKGROUND OF THE INVENTION

1. Field of the Invention

This invention relates to a process for producing a toner used in image forming processes, such as electrophotography, electrostatic recording and electrostatic printing, and to an apparatus for modifying surfaces of toner particles.

2. Related Background Art

In general, processes for producing toner particles may include pulverization and polymerization. Toner particles produced by pulverization are, under existing circumstances, advantageous in that they can be produced at a lower cost than those produced by the polymerization and are also at present widely used in toners for copying machines and printers. In the case when toner particles are produced by pulverization, a binder resin, a colorant, and so forth, are mixed in stated quantities, the mixture obtained is melt-kneaded, the kneaded product obtained is cooled, the kneaded product, thus cooled to solidify, is pulverized, the pulverized product obtained is classified to obtain toner particles having a stated particle size distribution, and a fluidity improver is externally added to the toner particles obtained, to produce a toner.

In recent years, there has been a demand for copying machines and printers that can achieve high image quality, energy savings, environmental adaptation, and so forth. For this reason, there is a shift to toners, in their technical concept, made of spherical toner particles to achieve high transfer efficiency and reduce waste toners. A method of making toner particles spherical by mechanical pulverization is proposed in Japanese Patent Application Laid-open No. H09-85741. Also, a method of making toner particles spherical by the action of hot air is proposed in Japanese Patent Application Laid-open No. 2000-29241. However, mechanical pulverization cannot provide sufficiently spherical toner particles. Also, if the process utilizes hot air, wax begins to melt when toner particles are incorporated with wax, which makes it difficult to control surface properties of toner particles and results in a problem of the quality stability of toner particles.

To cope with these issues, Japanese Patent Application Laid-open No. 2002-233787 proposes an apparatus for modifying surfaces of toner particles that also enables high-performance surface treatment and removal of fine powder. However, it is desirable to improve upon this surface modifying apparatus, because fine-powder removal efficiency, which is called classification efficiency, tends to decrease and image fog tends to occur when a high degree of spherical treatment is maintained.

SUMMARY OF THE INVENTION

An object of the present invention is to provide a process for producing a toner that solves the above-noted problems.

Another object of the present invention is to provide a process for producing highly spherical toner particles at a high yield.

Still another object of the present invention is to provide a process for efficiently producing a toner that cannot easily cause fogging of images.

A further object of the present invention is to provide an apparatus for modifying surfaces of toner particles with a good efficiency.

To achieve the above objects, the present invention provides a process for producing a toner containing toner particles, the process comprising:

a kneading step of melt-kneading a composition containing at least a binder resin and a colorant;

a cooling step of cooling the kneaded product obtained;

a pulverization step of finely pulverizing the resultant cooled and solidified product to obtain a finely pulverized product; and the step of simultaneously carrying out a surface modification step for making a surface modification of particles contained in the finely pulverized product obtained and a classification step of carrying out a classification for removing fine powder and ultrafine powder contained in the finely pulverized product obtained, to obtain toner particles, wherein:

the step of simultaneously carrying out the surface modification step and the classification step is carried out using a batch-wise surface modifying apparatus;

the surface modifying apparatus has at least:

a cylindrical main-body casing;

a worktop provided at the top of the main-body casing with an open-close operability;

an introduction area through which the finely pulverized product is introduced into the main-body casing;

a classifying means having a classifying rotor, which rotates in a stated direction so that fine powder and ultrafine powder having a particle diameter not larger than a stated particle diameter are continuously removed from the finely pulverized product that was introduced into the main-body casing and out of the apparatus;

a fine-powder discharge area through which the fine powder and ultrafine powder having been removed by the classifying means are discharged out of the main-body casing;

a surface modifying means having a dispersing rotor, which rotates in the same direction as the rotational direction of the classifying rotor, and a liner, which is stationarily disposed, so that particles contained in the finely pulverized product from which the fine powder and ultrafine powder has been removed are subjected to a surface modification treatment using a mechanical impact force;

a cylindrical guide means for forming a first space and a second space in the main-body casing; and a toner particle discharge area through which the toner particles subjected to surface modification treatment by means of the dispersing rotor are discharged out of the main-body casing;

the first space, which is provided between the inner wall of the main-body casing and the outer wall of the cylindrical guide means, is a space through which the finely pulverized product and the particles having been surface-modified are guided to the classifying rotor;

the second space is a space in which the finely pulverized product from which the fine powder and ultrafine powder have been removed and the particles having been surface-modified are treated by the dispersing rotor;

in the surface modifying apparatus, the finely pulverized product introduced into the main-body casing through the introduction area is led into the first space, the fine powder and ultrafine powder having particle diameter not larger than the stated particle diameter are removed by the classifying means and continuously discharged out of the apparatus, during which the finely pulverized product from which the fine powder and ultrafine powder have been removed is moved to the second space, and treated by the dispersing rotor to carry out the surface modification treatment of the particles contained in the finely pulverized product, and the finely pulverized product containing the surface-modified particles are again circulated to the first space and the second space to repeat the classification and the surface modification treatment, to thereby obtain toner particles from which the fine powder and ultrafine powder having particle diameter not larger than the stated particle diameter have been removed at a quantity not more than a stated quantity and which have been surface-modified;

the introduction area is formed at the sidewall of the main-body casing, and the fine-powder discharge area is formed at the top of the main-body casing;

the dispersing rotor has an outer diameter of 120 mm or more; and the minimum gap between the dispersing rotor and the liner is from 1.0 mm to 3.0 mm.

The present invention further provides a batch-wise surface modifying apparatus for classifying a toner particle material powder and carrying out a treatment for making toner particles spherical. The apparatus having at least:

a main-body casing;

a worktop provided at the top of the main-body casing with an open-close operability;

an introduction area through which the material powder is introduced into the main-body casing;

a classifying means having a classifying rotor by means of which fine powder and ultrafine powder having particle diameter not larger than a stated particle diameter are continuously removed from the material powder introduced into the main-body casing;

a fine-powder discharge area through which the fine powder and ultrafine powder removed by the classifying means are discharged out of the main-body casing;

a surface modifying means having a dispersing rotor and a liner so that particles contained in the finely pulverized product from which the fine powder and ultrafine powder have been removed are subjected to a surface modification treatment using a mechanical impact force;

a cylindrical guide means for forming a first space and a second space in the main-body casing; and a toner particle discharge area through which the toner particles subjected to the surface modification treatment by means of the dispersing rotor and the liner are discharged out of the main-body casing;

the first space, which is provided between the inner wall of the main-body casing and the outer wall of the cylindrical guide means, is a space through which the material powder and the surface-modified particles are guided to the classifying rotor;

the second space is a space in which the material powder, from which the fine powder and ultrafine powder have been removed, and the surface-modified particles are treated by the dispersing rotor;

in the surface modifying apparatus, the material powder introduced into the main-body casing through the introduction area is led into the first space, the fine powder and ultrafine powder having a particle diameter not larger than the stated particle diameter are removed by the classifying means and continuously discharged out of the apparatus, during which the material powder, from which the fine powder and ultrafine powder have been removed, are moved to the second space and treated by the dispersing rotor and the liner to carry out the surface modification treatment of the toner particles contained in the material powder, and the material powder containing the surface-modified toner particles is again circulated to the first space and the second space to repeat the classification and the surface modification treatment, to thereby obtain surface-modified toner particles, from which the fine powder and ultrafine powder having a particle diameter not larger than the stated particle diameter have been removed, at a quantity of not more than the stated quantity;

the dispersing rotor has at the top surface thereof a plurality of rectangular disks;

the dispersing rotor has an outer diameter of 120 mm or more; and the minimum gap between the dispersing rotor and the liner is from 1.0 mm to 3.0 mm.

DESCRIPTION OF THE PREFERRED EMBODIMENTS

Figure 1:
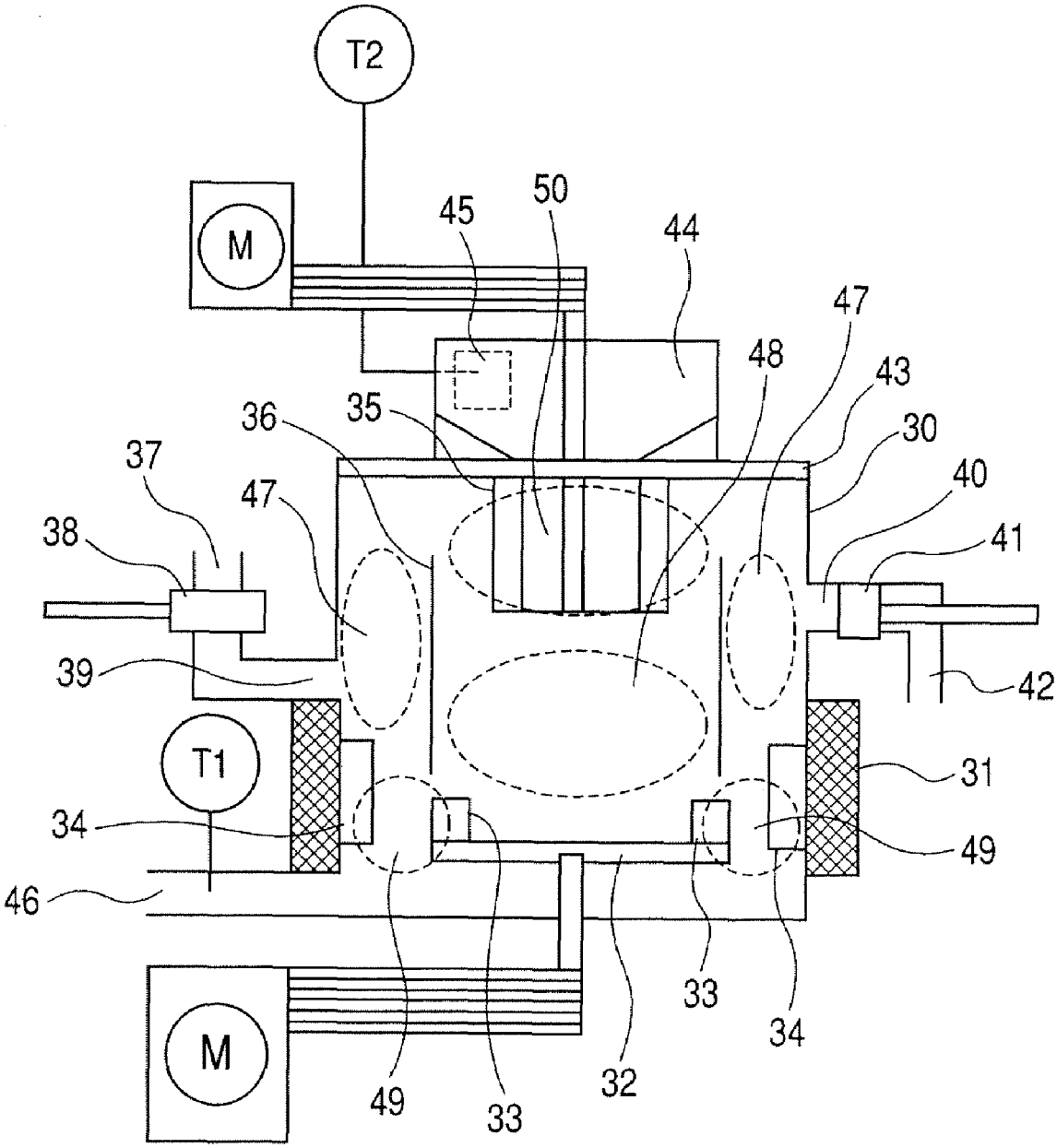
FIG. 1 is a schematic sectional view of an example of a batch-wise surface modifying apparatus used in the surface modification step in the present invention.

The present inventors have conducted extensive studies to solve the above problems of the related background art and have found that, in a batch-wise surface modifying apparatus, which classifies a toner particle material powder and carries out treatment for making toner particles spherical, the positional relationship between a dispersing rotor and a liner may be set to an appropriate state to prevent excessive pulverization of toner particles and to reduce the effect generated by heat. As a result, toner particles that have a narrow particle size distribution with less fine powder and better sphericity can be obtained at a good efficiency. Also, the surface shape of toner particles can be controlled at a good efficiency. The inventors have further found that the surface modification treatment of toner particles may be carried out using a surface modifying apparatus of the present invention, whereby toner particles that have good developing performance, transfer performance, cleaning performance, and stable chargeability can be obtained.

The present invention is described below in detail via preferred embodiments.

The surface modifying apparatus used in the production process of the present invention is described first.

The surface modifying apparatus of the present invention is a batch-wise apparatus for simultaneously carrying out the step of classifying and removing fine powder and ultrafine powder contained in a finely pulverized product and the step of surface modification treatment of particles contained in the finely pulverized product.

The surface modifying apparatus of the present invention has at least:

a cylindrical main-body casing;

a worktop provided open-close operably at the top of the main-body casing;

an introduction area through which the finely pulverized product is introduced into the main-body casing;

a classifying means having a classifying rotor, which rotates in a stated direction so that fine powder and ultrafine powder having particle diameter not larger than stated particle diameter are continuously removed out of the apparatus from the finely pulverized product that was introduced into the main-body casing;

a fine-powder discharge area through which the fine powder and ultrafine powder removed by the classifying means are discharged out of the main-body casing;

a surface modifying means having a dispersing rotor, which rotates in the same direction as the rotational direction of the classifying rotor and a liner that is disposed in a stationary state, so that particles contained in the finely pulverized product, from which the fine powder and ultrafine powder have been removed, are subjected to surface modification treatment using a mechanical impact force;

a cylindrical guide means for forming a first space and a second space in the main-body casing; and a toner particle discharge area through which the toner particles subjected to surface modification treatment by the dispersing rotor are discharged out of the main-body casing;

the first space, which is provided between the inner wall of the main-body casing and the outer wall of the cylindrical guide means, is a space through which the finely pulverized product and the surface-modified particles are guided to the classifying rotor;

the second space is a space in which the finely pulverized product, from which the fine powder and ultrafine powder have been removed, and the surface-modified particles are treated by the dispersing rotor.

In the surface modifying apparatus, the finely pulverized product is led into the first space, the fine powder and ultrafine powder having a particle diameter not larger than the stated particle diameter are removed by the classifying means and continuously discharged out of the apparatus. The finely pulverized product, from which the fine powder and ultrafine powder have been removed, are moved to the second space and treated by the dispersing rotor to carry out the surface modification treatment of the particles contained in the finely pulverized product. The finely pulverized product containing the surface-modified particles is again circulated to the first space and the second space to repeat the classification and the surface modification treatment to obtain toner surface-modified particles from which the fine powder and ultrafine powder having particle diameter not larger than the stated particle diameter have been removed at a quantity not more than stated quantity. The dispersing rotor has an outer diameter of 120 mm or more. The minimum gap between the dispersing rotor and the liner is from 1.0 mm to 3.0 mm.

Figure 2A:
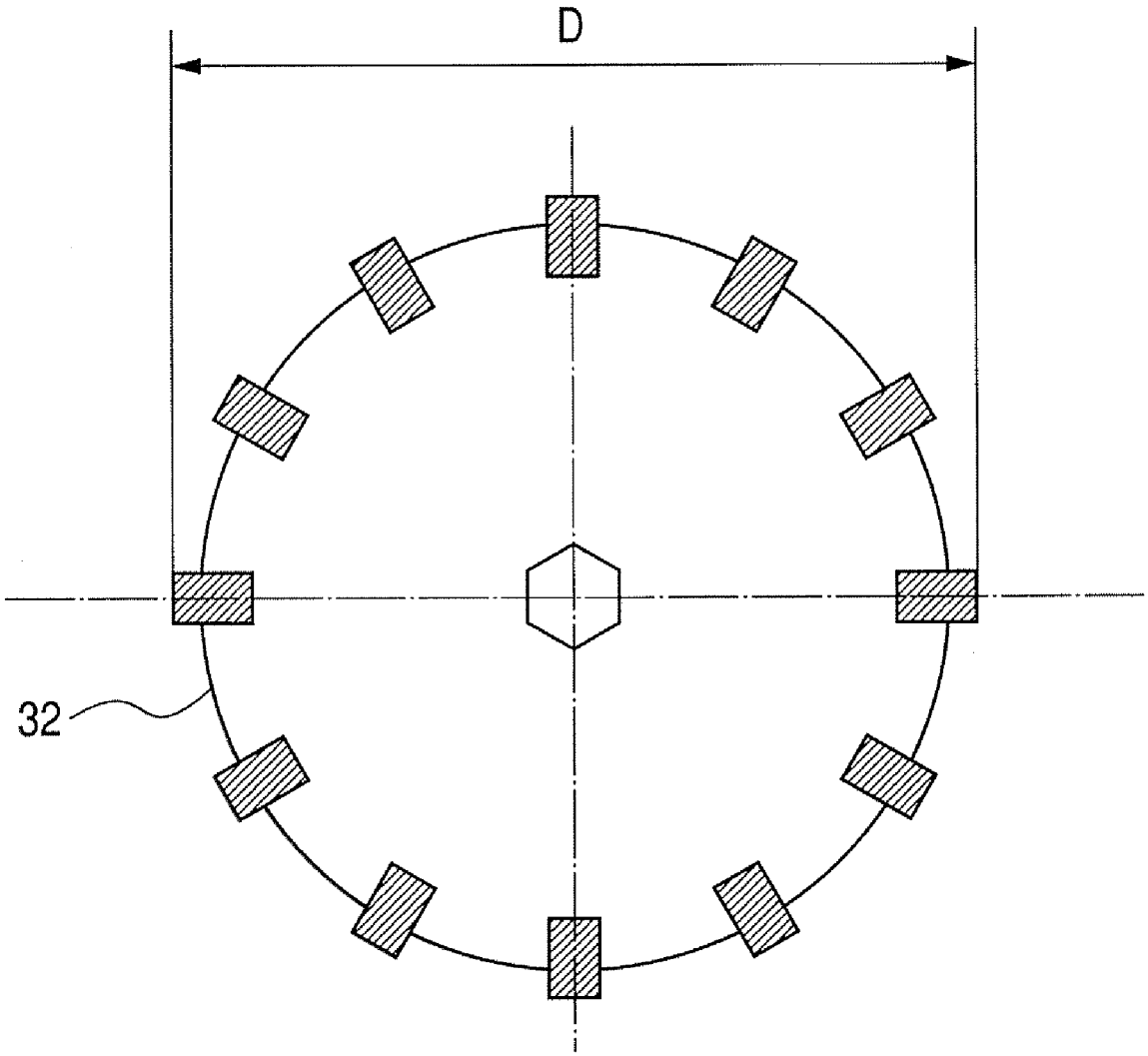
FIG. 2A is a horizontal plane-of-projection view of a dispersing rotor.
Figure 2B:
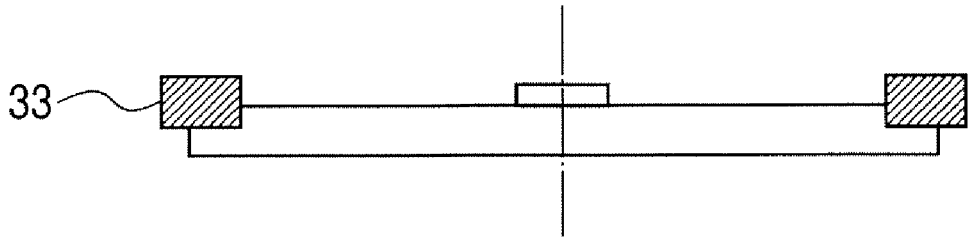
FIG. 2B is a vertical plane-of-projection view of the dispersing rotor.
Figure 3:
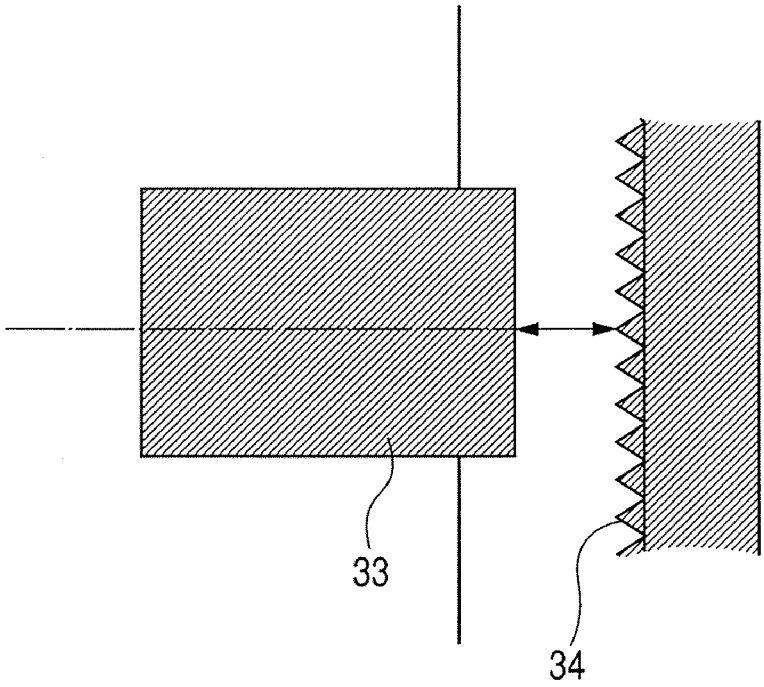
FIG. 3 is a schematic sectional view showing the relationship between rectangular disks of a dispersing rotor and a liner.
Figure 4:
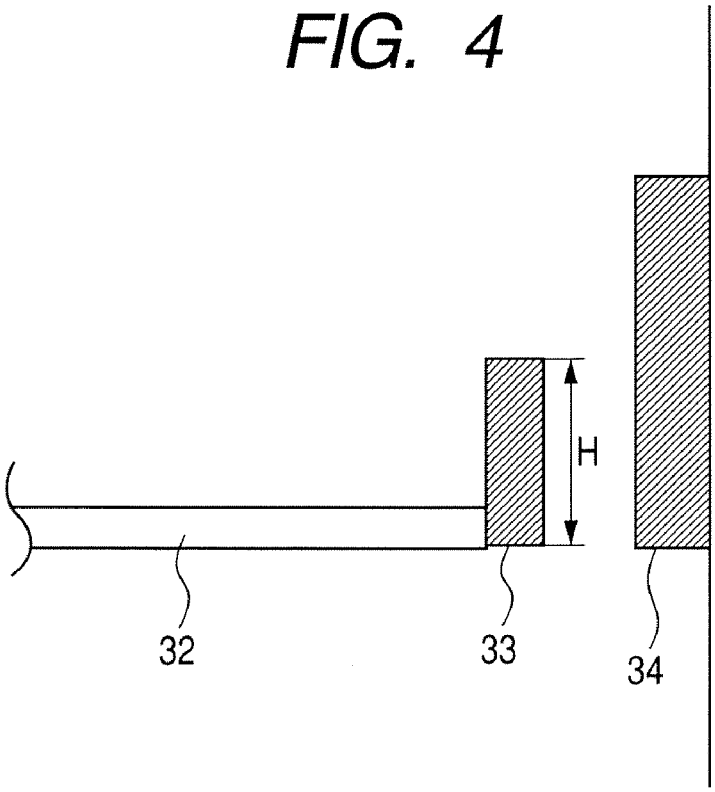
FIG. 4 is a schematic sectional view showing the height of each rectangular disk of the dispersing rotor.

FIG. 1 is a schematic sectional view showing a preferred example of the surface modifying apparatus used in the present invention. FIG. 2A and FIG. 2B are illustrations for describing the outer diameter D of a dispersing rotor 32 having disks 33. FIG. 3 is an illustration for describing the minimum gap between the dispersing rotor 32 and the liner 34. FIG. 4 is an illustration for describing height H of each disk 33.

The batch-wise surface modifying apparatus shown in FIG. 1 has a cylindrical main-body casing; a worktop 43 provided open-close operably at the top of the main-body casing; a fine-powder discharge area 44 having a fine-powder discharge casing and a fine-powder discharge pipe; a cooling jacket 31 through which cooling water or an anti-freeze can be let to run; a dispersing rotor 32 as the surface modifying means, which is a disk-shaped rotary member rotatable at a high speed in a stated direction, provided in the main-body casing 30 and attached to the center rotational shaft and having a plurality of rectangular disks 33 at the top surface; a liner 34 disposed stationarily at a constant distance around the dispersing rotor 36 and provided with a large number of grooves on its surface; a classifying rotor 35 for continuously removing fine powder and ultrafine powder having a particle diameter not larger than the stated particle diameter contained in the finely pulverized product; a cold air inlet 46 for leading cold air therethrough into the main-body casing 30; an introduction pipe having a material powder introducing opening 37 and a material powder feed opening 39 formed on the sidewall of the main-body casing 30 in order to lead in therethrough the finely pulverized product (material powder); a product discharge pipe having a product discharge opening 40 and a product take-off opening 42 through which toner particles treated for surface modification are discharged out of the main-body casing 30; a material powder feed valve 38 with an open-close operability provided between the material powder introducing opening 37 and the material powder feed opening 39 so that surface modification time can be freely controlled; and a product discharge valve 41 provided between the product discharge opening 40 and the product take-off opening 42.

One of characteristic features of the surface modifying apparatus used in the toner production process of the present invention is that the dispersing rotor 32 has an outer diameter D of 120 mm or more and the minimum gap between the disks 33 provided at the top surface of the dispersing rotor 32 and the liner 34 is set to from 1.0 mm to 3.0 mm. Preferably, the dispersing rotor 32 may have an outer diameter D of from 200 mm to 600 mm. Further, the disks 33 may preferably be rectangular disks, as mentioned previously.

The minimum gap between the disks 33 provided at the top surface of the dispersing rotor 32 and the liner 34 (i.e., the minimum gap between the dispersing rotor and the liner) is meant to be, as shown in FIG. 3, the shortest distance between the middle of each disk 33 provided at the top surface of the dispersing rotor 32 and the end face of the liner 34.

Inasmuch as the minimum gap between the disks 33 provided at the top surface of the dispersing rotor 32 and the liner 34 is set to from 1.0 mm to 3.0 mm, the toner particles can be prevented from being excessively pulverized concurrently with the surface modification of toner particles and may be less affected by heat. Also, highly spherical toner particles having a narrow particle size distribution with less fine powder and ultrafine powder can be obtained with a good efficiency. In addition, the surface shape of toner particles can be controlled as desired, and a long-lifetime toner, which has good developing performance, good transfer performance, good cleaning performance, and stable chargeability can be obtained.

The surface shape of the toner particles treated for surface modification is influenced by the minimum gap between the plurality of disks 33 provided at the top surface of the dispersing rotor 32 and the liner 34 disposed in a stationary manner around the dispersing rotor 36 with a constant distance between them. It is important to control how the surface treatment of toner particles is carried out between the disks and the liner by controlling to an appropriate state the minimum gap between the disks 33 provided at the top surface of the dispersing rotor 32 and the liner 34. In the present invention, the batch-wise surface modifying apparatus shown in FIG. 1 is used as the surface modifying apparatus in the surface modification treatment step. The time for the treatment of the toner particles after the material powder feed valve 38 is closed and until the product discharge valve 41 is opened and the minimum gap between the disks 33 provided at the top surface of the dispersing rotor 32 and the liner 34 are controlled to an appropriate state. This prevents an increase in the amount of fine powder and ultrafine powder at the time of surface modification treatment and enables the surface shape of toner particles to be controlled well, as desired.

The liner 34 may preferably be provided with a large number of grooves on its surface. In order to control the surface shape of toner particles, it is important to control the residence time of the toner particles in the surface modifying apparatus.

If the minimum gap between the dispersing rotor 32 and the liner 34 is set at less than 1.0 mm, the apparatus itself may have such a large load, that the toner particles tend to excessively pulverize at the time of surface modification, the surface properties of the toner particles tend to change because of heat, or the apparatus tends to cause melt adhesion of toner particles in its interior, resulting in a decrease in productivity of the toner particles. If the minimum gap between the dispersing rotor 32 and the liner 34 is set at more than 3.0 mm, the dispersing rotor 32 must be driven at a high speed in order to obtain highly spherical toner particles, resulting in excessive pulverization of the toner particles at the time of surface modification, the surface properties of toner particles tend to change due to heat, or the apparatus tends to cause melt adhesion of toner particles in its interior, resulting in a decrease in productivity of the toner particles.

It is further preferable that, where the number of the disks 33 provided at the top surface of the dispersing rotor 32 is represented by n and the external diameter of the dispersing rotor 32 by D (see FIG. 2), the relationship of the following expression (1) is met:

$$\pi \times D/n \leqq 95.0 \text{ (mm)} \quad (1).$$

Inasmuch as the relationship of the above expression (1) is satisfied, where the number of the disks 33 provided at the top surface of the dispersing rotor 32 is represented by n and the external diameter of the dispersing rotor 32 by D, highly spherical toner particles can be obtained with a good efficiency. Also, the surface shape of toner particles can be better controlled, as desired. As a result, long-lifetime toner, which has good developing performance, good transfer performance, good cleaning performance, and stable chargeability, can be obtained.

If the value of $\pi \times D/n$ is more than 95.0 (mm), the dispersing rotor 32 must be driven at a high speed in order to obtain highly spherical toner particles. This places such a large load on the apparatus that productivity of the toner particles tends to decrease.

It is still further preferable that, where the height of each disk 33 provided at the top surface of the dispersing rotor 32 is represented by Hand the external diameter of the dispersing rotor 32 by D, the value of $\alpha$ calculated from the following expression (2) satisfies the relationship of the following expression (3):

$$H = \sqrt{D} \times \alpha + 10.5 \quad (2),$$

$$1.15 < \alpha < 2.17 \quad (3).$$

As a result of the studies conducted by the present inventors, it has been determined that when the value of $\alpha$ calculated from the above expression (2) satisfies the relationship of the above expression (3) where the height of each rectangular disk 33 provided at the top surface of the dispersing rotor 32 is represented by H and the external diameter of the dispersing rotor 32 by D, highly spherical toner particles can be obtained with a good efficiency. Also, the surface shape of surface-modified toner particles can be better controlled as desired, so that the long-lifetime toner, which has good developing performance, good transfer performance, good cleaning performance, and stable chargeability can be obtained.

Inasmuch as the value of $\alpha$ calculated from the above expression (2) satisfies $1.15<\alpha<2.17$, where the height of each disk provided at the top surface of the dispersing rotor 32 is represented by H and the external diameter of the dispersing rotor 32 by D, highly spherical toner particles can be obtained with a good efficiency. Also, the surface shape of surface-modified toner particles can be better controlled, as desired. The surface shape of surface-modified toner particles can be controlled even if the value of $\alpha$ is less than 1.15. However, setting the value of $\alpha$ to $1.15<\alpha<2.17$ improves the productivity of the toner particles.

Figure 10A:
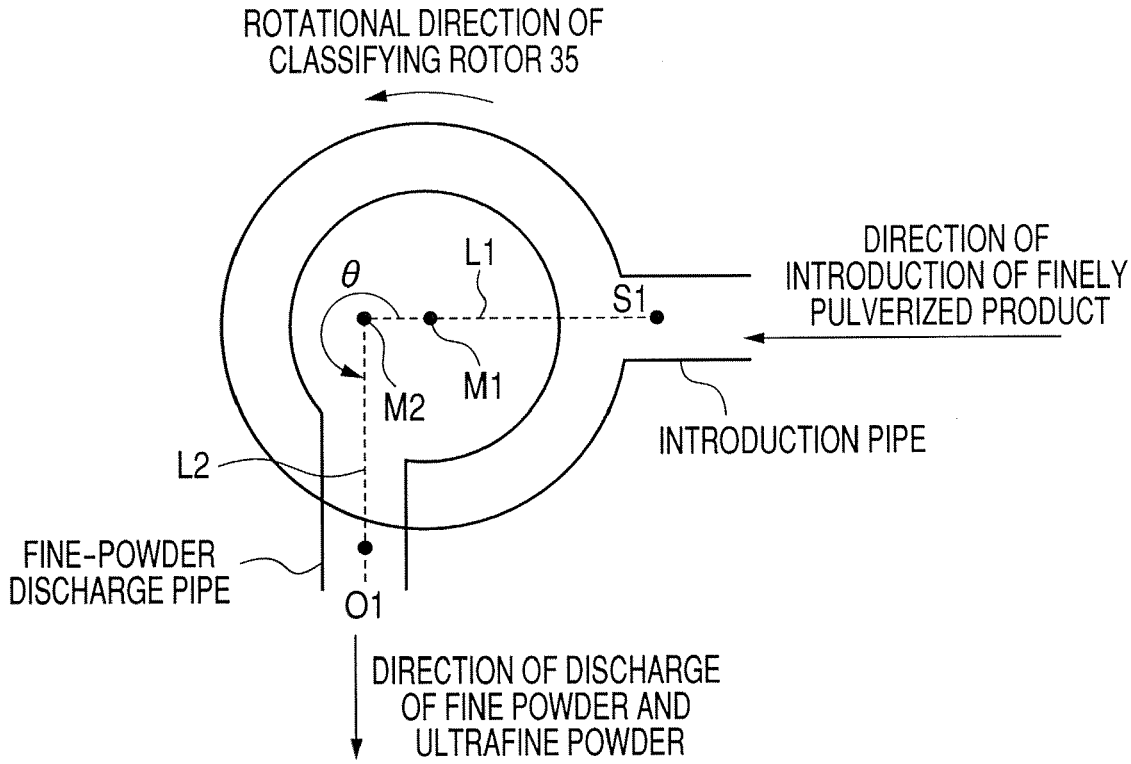
FIG. 10A is a top projection view (horizontal plane-of-projection view) of the surface modifying apparatus shown in FIG. 1.
Figure 10B:
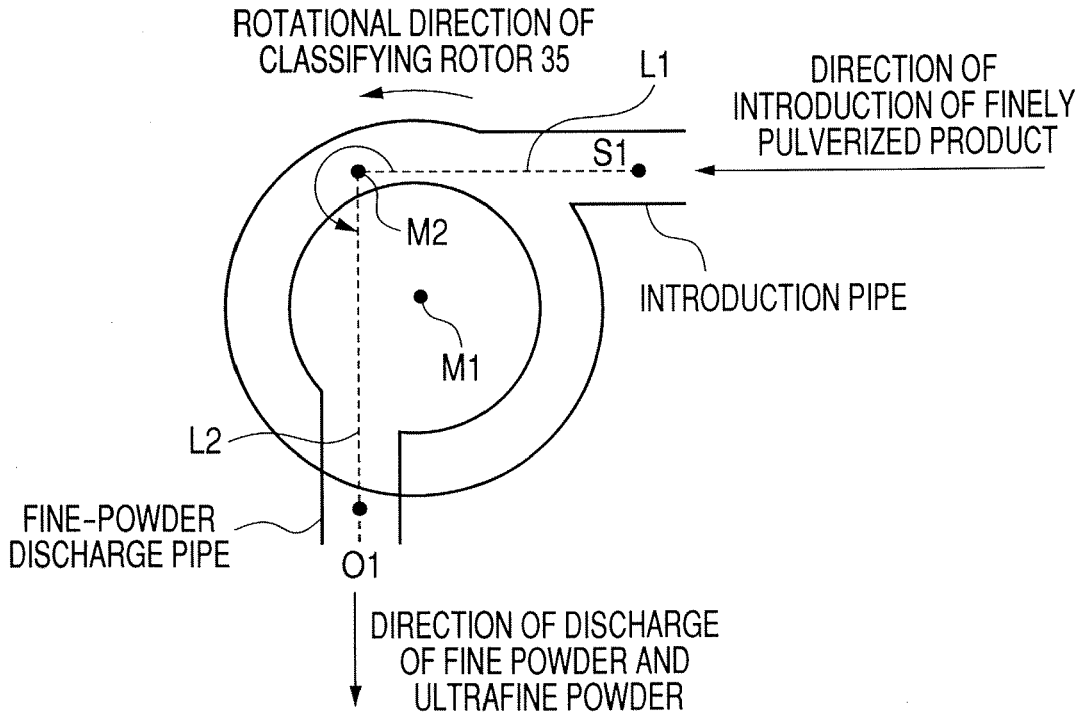
FIG. 10B is another top projection view.

The liner 34 having the grooves as shown in FIG. 3 is preferable in order for the toner particles to be efficiently surface-modified. The number of the disks 33 may preferably be even, as shown in Table 2A, due to the rotation balance of the dispersing rotor 32. The dispersing rotor 32, as shown in FIGS. 10A and 10B, typically rotates in a counter-clockwise direction as viewed from the top of the apparatus.

Figure 12:
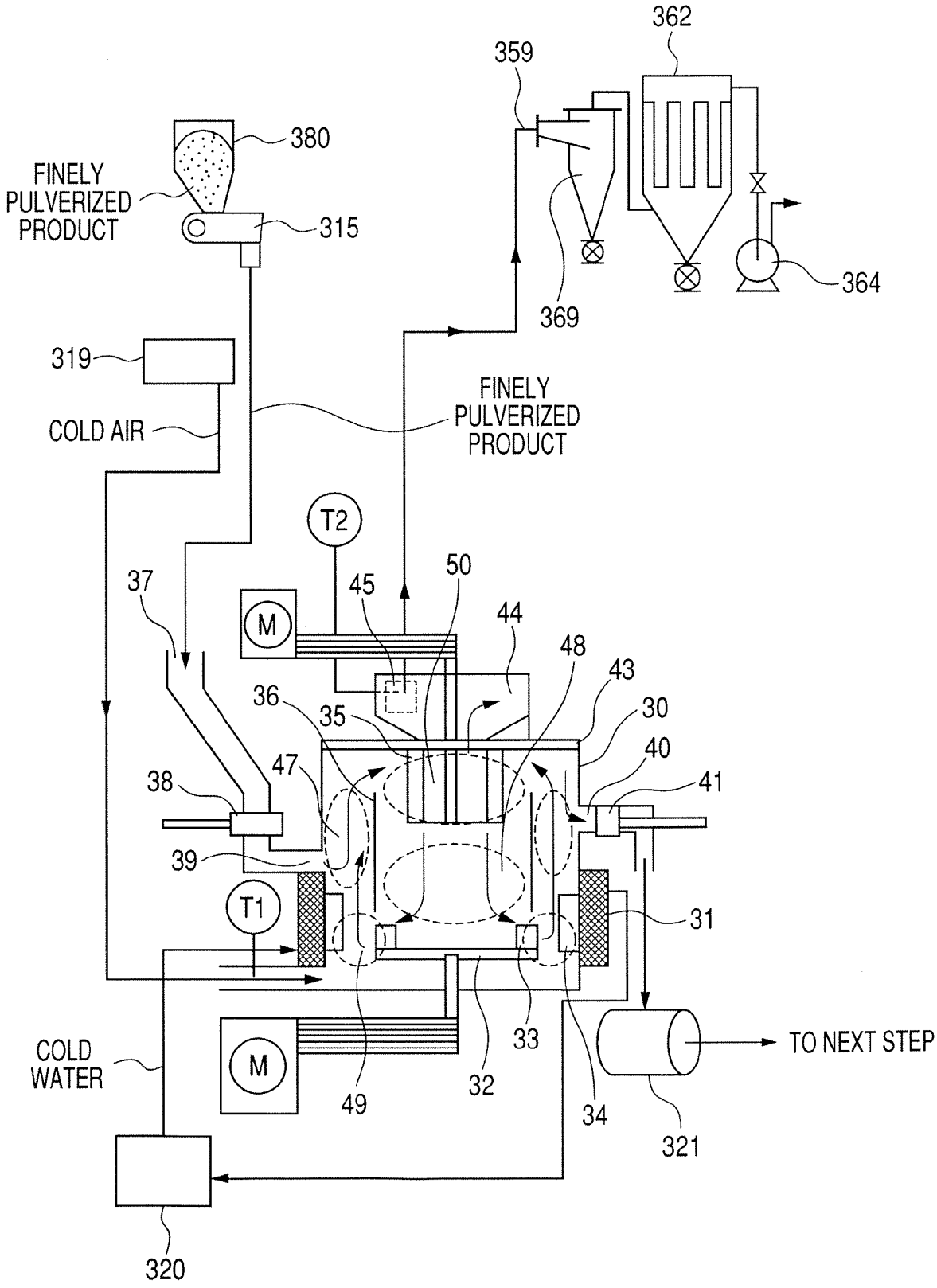
FIG. 12 is a partial flow sheet for describing the toner production process of the present invention.

The classifying rotor 35 shown in FIGS. 1 and 12 is rotated in the same direction as the rotational direction of the dispersing rotor 32. This is preferable in order to improve the efficiency of classification and the efficiency of surface modification of the toner particles.

The surface modifying apparatus further has, in the main-body casing 30, a cylindrical guide ring 36 as a guide means having an axis that is vertical to the worktop 43. The guide ring 36 is provided so that its upper end is separated from the worktop 43 by a stated distance. The guide ring 36 is set stationary to the main-body casing 30 by a support in such a way that it covers at least a part of the classifying rotor 35. The guide ring 36 is also provided so that its lower end is separated from the rectangular disks 33 of the dispersing rotor 32 by a stated distance. In the surface modifying apparatus, the space defined between the classifying rotor 35 and the dispersing rotor 32 is divided by the guide ring 36 into a first space 47 on the outer side of the guide ring 36 and a second space 48 on the inner side of the guide ring 36. The first space 47 is a space through which the finely pulverized product and the particles treated for surface modification are guided to the classifying rotor 35. The second space 48 is a space in which the finely pulverized product and the particles treated for surface modification are guided to the dispersing rotor 32. The gap portion between the plurality of rectangular disks 33 on the dispersing rotor 32 and the liner 34 is a surface modification zone 49.

The classifying rotor 35 and the peripheral portion of the classifying rotor 35 form a classification zone 50.

The fine-powder discharge pipe has a fine-powder discharge opening 45 through which the fine powder and ultrafine powder removed by the classifying rotor 35 are discharged out of the apparatus.

Figure 11:
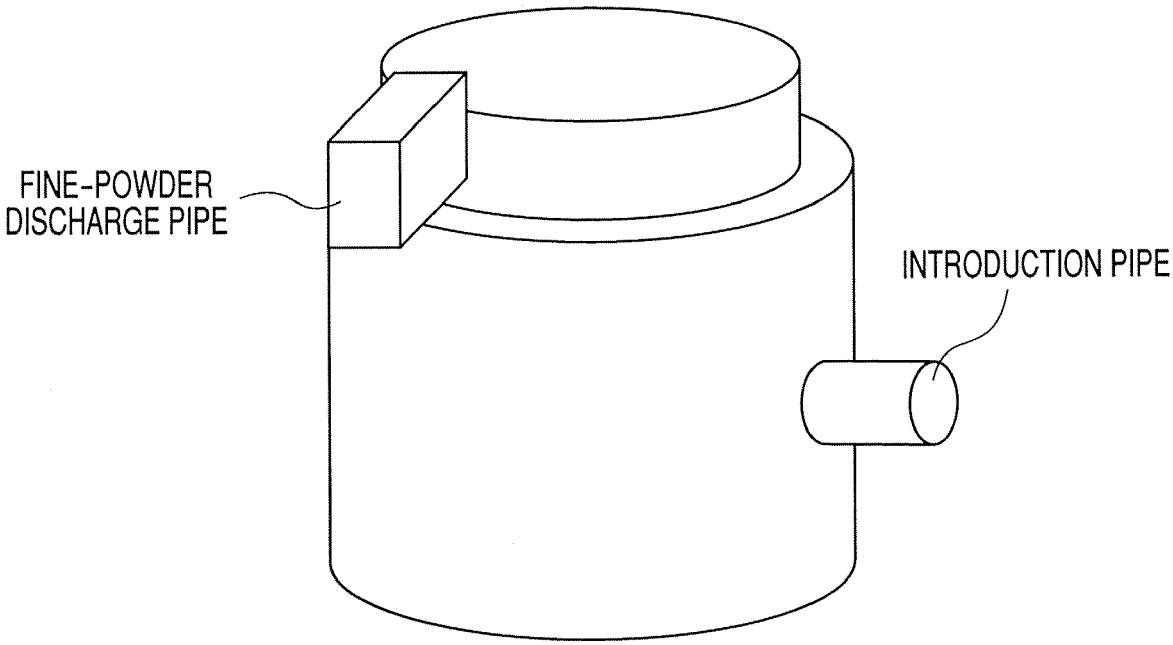
FIG. 11 is a partial schematic perspective view of the surface modifying apparatus shown in FIG. 1.

FIGS. 10A and 10B are views for describing an angle θ formed by the introduction pipe of the introduction area and the fine-powder discharge pipe of the fine-powder discharge area and are schematic top projection views (horizontal plane-of-projection view) of the surface modifying apparatus shown in FIG. 1. FIG. 11 is a schematic perspective view for describing the positional relationship between the introduction pipe of the introduction area and the fine-powder discharge pipe of the fine-powder discharge area of the surface modifying apparatus.

Figure 8:
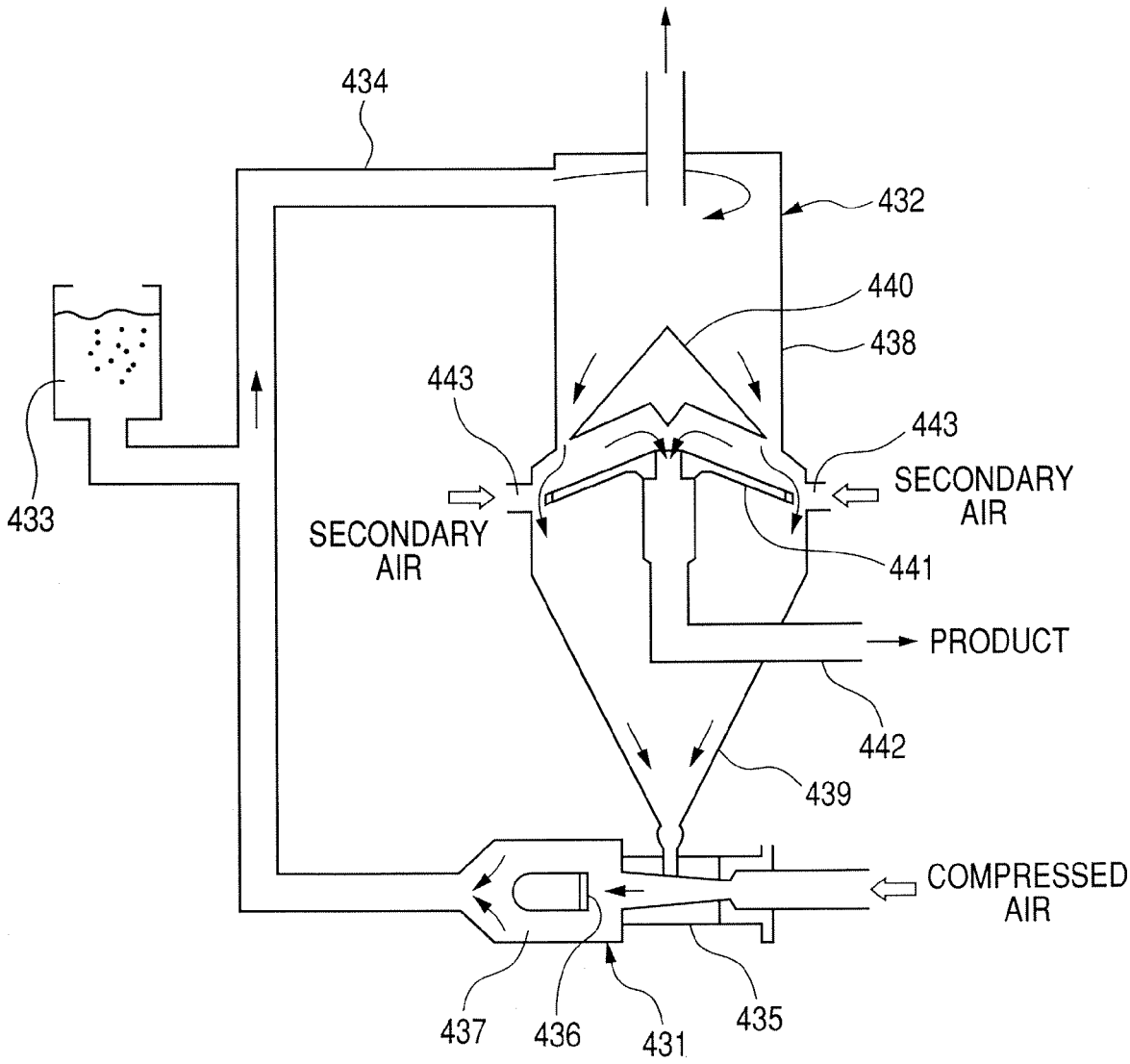
FIG. 8 is a schematic sectional view of an apparatus used in the fine pulverization step and the classification step.

The finely pulverized product to be led into the surface modifying apparatus may be prepared by feeding a coarsely pulverized product into, e.g., a fine pulverization system shown in FIG. 8. The coarsely pulverized product can be obtained by crushing a solid material obtained by cooling a melt-kneaded product. In the fine pulverization system, the coarsely pulverized product is led into a material powder feeder 433 and then led into an air classifier 441 from the material powder feeder 433 via a transport pipe 434. The air classifier 441 has a center core 440 and a separate core 441 in a collector 438. In the air classifier 432, the coarsely pulverized product is classified into a finely pulverized product and coarse particles by the aid of secondary air led in through a secondary air feed opening 443. The thus classified finely pulverized product is discharged out of the system via a discharge pipe 442 and then led into a material powder hopper 380 shown in FIG. 12. The thus classified coarse particles are led into a fine grinding machine (e.g., a jet mill) 431 via a main-body hopper 439. In the fine grinding machine, the coarse particles are fed to a nozzle 435 into which compressed air is kept led. The coarse particles are transported by high-speed compressed air and then collided against a collision plate 436 in a pulverizing chamber 437 so as to be finely pulverized. The finely pulverized product of the coarse particles is led into the air classifier 432 via the transport pipe 434 and is again classified. The finely pulverized product may have a weight-average particle diameter from 3.5 μm to 9.0 μm. In this product, from 30% to 70% of particles may have a particle diameter of 3.17 μm or less. This is preferable in order to simultaneously carry out the step of classification and the step of surface modification with a good efficiency in the surface modifying apparatus in a post step.

As shown in FIG. 12, the finely pulverized product led into the material powder hopper 380 is fed via a constant-rate feeder 315 into the surface modifying apparatus through the material introducing opening 37 and through the material feed opening 39 of the introduction pipe, passing the material feed valve 38. In the surface modifying apparatus, cold air generated in a cold-air generating means 319 is fed into the main-body casing 30 through the cold air inlet 46, and cold water from a cold-water generating means 320 is fed to the cooling jacket 31 to adjust the internal temperature of the main-body casing 30 to a stated temperature. The finely pulverized product thus fed is transported by suction air flow produced by a blower 364 and by whirling currents formed by the rotation of the dispersing rotor 32 and the rotation of the classifying rotor 35 to reach a classification zone 50 in the vicinity of the classifying rotor 35 while the finely pulverized product whirls in the first space 47 on the outer side of the cylindrical guide ring 36, where the classification is carried out. The direction of whirls formed in the main-body casing 30 is the same as the rotational directions of the dispersing rotor 32 and classifying rotor 35. Hence it is a counter-clockwise direction as viewed from the top of the apparatus.

In the surface modifying apparatus, it is preferable that the contact surface portion between the worktop 43 and the classifying rotor 35 is not brought into close contact, but a suitable gap is provided between them. The gap at the face-to-face surface portion between the classifying rotor 35 and the worktop 43 may preferably be 1.0 mm or less, and more preferably from 0.1 mm to 0.9 mm. It is more preferable that these are constructed so that air is blown out through the gap. If this gap is more than 1.0 mm, there is a possibility of short-passing the toner particles through the gap to the inner wall of the casing 30 without passing the classifying rotor 35. The air blowing out through the gap may preferably be at a flow rate of 0.5 $m^3$/min or more, and more preferably 1.0 $m^3$/min or more. Air pressure may preferably be 0.05 MPa or more, and more preferably 0.1 MPa or more.

In the toner production process of the present invention, it is further preferable that the time for surface modification of toner particles in the surface modifying apparatus is from 5 seconds to 180 seconds, and more preferably from 15 seconds to 120 seconds. If the surface modification time is less than 5 seconds, it may be difficult to obtain good quality, highly spherical toner particles. If, however, the surface modification time is more than 180 seconds, the surface modification time is so excessively long that the surface properties of the toner particles tend to change because of the heat generated at the time of surface modification and the apparatus tends to cause melt adhesion of toner particles in its interior, tending to result in a decrease in productivity of the toner particles.

In the toner production process of the present invention, it is still further preferable that the rotor end peripheral speed at the time of rotation of the dispersing rotor 32 is set to from 30 to 175 m/sec, and more preferably from 40 to 160 m/sec. If the peripheral speed of the dispersing rotor 32 is less than 30 m/sec, the throughput capacity must be decreased in order to obtain toner particles having the stated sphericity. This tends to result in a decrease in productivity of the toner particles. If, however, the peripheral speed of the dispersing rotor 32 is more than 175 m/sec, the apparatus itself may have such a large load that the toner particles tend to excessively pulverize at the time of surface modification, and the surface properties of the toner particles tend to change because of heat, or the apparatus tends to cause melt adhesion of toner particles in its interior.

In the toner production process of the present invention, it is still further preferable that the minimum distance between the top surfaces of the disks 33 provided at the top surface of the dispersing rotor 32 and the lower end of the cylindrical guide ring 36 in the surface modifying apparatus be set to from 2.0 mm to 50.0 mm, and more preferably from 5.0 mm to 45.0 mm. If the minimum distance between the top surfaces of the disks 33 provided at the top surface of the dispersing rotor 32 and the lower end of the cylindrical guide ring 36 is less than 2.0 mm, the apparatus itself tends to have such a large load that the toner particles tend to stay in the first space on the inner side of the guide ring 36 for a long time and excessively pulverize at the time of surface modification and their surface properties tend to change because of heat, or the apparatus tends to cause melt adhesion of toner particles in its interior. If, however, the minimum distance between the top surfaces of the disks 33 and the lower end of the cylindrical guide ring 36 is more than 50.0 mm, the toner particles tends to flow out to the second space on the outer side of the guide ring 36 before they are sufficiently surface-modified.

In the toner production process of the present invention, it is still further preferable that the minimum distance between the guide ring 36 in the surface modifying apparatus and the inner wall of the apparatus be set to from 20.0 mm to 60.0 mm, and more preferably from 25.0 mm to 55.0 mm. If the minimum distance between the guide ring 36 in the surface modifying apparatus and the inner wall of the apparatus is less than 20.0 mm, the toner particles tend to remain in the first space on the inner side of the guide ring 36 for a long time, so that there is a possibility that the toner particles flow out to the first space on the outer side of the guide ring 36 before they are sufficiently surface-modified, tending to result in a decrease in productivity of the toner particles. If, however, the minimum distance between the guide ring 36 in the surface modifying apparatus and the inner wall of the apparatus is more than 60.0 mm, the toner particles may remain in the vicinity of the dispersing rotor 32 for a long time and excessively pulverize at the time of surface modification. Also, the surface properties of the toner particles tend to change because of heat or the apparatus tends to cause melt adhesion of toner particles in its interior.

In the toner production process of the present invention, it is still further preferable that cold-air temperature T1 at which the cold air is led into the surface modifying apparatus be controlled to 5° C. or less. Inasmuch as the temperature T1 at which the cold air is led into the surface modifying apparatus is controlled to 5° C. or less, which is more preferably 0° C. or less, and still more preferably from −5° C. to −40° C., it is possible to keep surface properties the toner particles from changing due to the heat generated at the time of surface modification and to prevent the apparatus from causing melt adhesion of toner particles in its interior. If the cold-air temperature T1 at which the cold air is led into the surface modifying apparatus is more than 5° C., the surface properties of the toner particles tend to change because of the heat generated at the time of surface modification and the apparatus tends to cause melt adhesion of toner particles in its interior.

Due to environmental concerns, an alternative chlorofluorocarbon is a preferred refrigerant for use in the cold-air generating means. Alternative chlorofluorocarbons include R134a, R404A, R407c, R410A, R507A and R717. Of these, R404A is particularly preferred in view of energy conservation and safety.

The cold air to be led into the surface modifying apparatus may be dehumidified air from the viewpoint of preventing moisture condensation inside the apparatus. This is preferable in view of productivity of the toner particles. Any known apparatus may be used for dehumidifying the cold air. The air feed dew point is preferably −15° C. or less, and more preferably −20° C. or less.

Further, the surface modifying apparatus may preferably further have a jacket for cooling (the cooling jacket 31). It is preferable to treat the toner particles for surface modification while letting a refrigerant (preferably cooling water, and more preferably an anti-freeze, such as ethylene glycol) run through the interior of the jacket. Inasmuch as the interior of the apparatus is cooled by this jacket, the change in the surface properties of the toner particles due to heat generated at the time of surface modification can be prevented and the apparatus can be prevented from causing melt adhesion of toner particles in its interior.

The temperature of the refrigerant let to run through the interior of the jacket of the surface modifying apparatus may preferably be controlled to 5° C. or less. In the batch-wise toner particle surface modifying apparatus, the temperature may more preferably be controlled to 0° C. or less, and still more preferably to −5° C. or less. Thus, the change in the surface properties of the toner particles due to heat generated at the time of surface modification can be prevented and the apparatus can be prevented from causing melt adhesion of toner particles in its interior.

In the toner production process of the present invention, it is also preferable that temperature T2 in the fine-powder discharge opening 45 at the rear of the classifying rotor 35 in the surface modifying apparatus is set at 60° C. or less. Inasmuch as the temperature T2 is 60° C. or less, which may more preferably be 50° C. or less, the change in the surface properties of the toner particles due to heat generated at the time of surface modification can be prevented and the apparatus can be prevented from causing melt adhesion of toner particles in its interior.

In the toner production process of the present invention, it is further preferable that temperature difference ΔT between the temperature T2 in the fine-powder discharge opening 45 and the cold-air temperature T1 at which the cold air is led into the surface modifying apparatus, T2-T1, be controlled to 100° C. or less. When ΔT (T2-T1) is 100° C. or less, more preferably 80° C. or less, the change in the surface properties of the toner particles due to heat generated at the time of surface modification can be prevented and the apparatus can be prevented from causing melt adhesion of toner particles in its interior.

The fine powder and ultrafine powder to be removed by the classifying rotor 35 are sucked through slits of the classifying rotor 35 by the aid of suction force of the blower 364 and are collected in a cyclone 369 and a bag filter 362 via the fine-powder discharge opening 45 of the fine-powder discharge pipe and a cyclone inlet 359. The finely pulverized product from which the fine powder and ultrafine powder have been removed reaches the surface modification zone 49 in the vicinity of the dispersing rotor 32 via the second space 48, where the particles are treated for surface modification by means of the rectangular disks 33 (hammers) provided on the dispersing rotor 32 and the liner 34 provided on the main-body casing 30. The particles having been surface-modified again reach the vicinity of the classifying rotor 35 while whirling along the guide ring 36. Fine powder and ultrafine powder are removed from the surface-modified particles by the classification the classifying rotor 35 carries out. After the treatment was carried out for a stated time, the product discharge valve 41 is opened and the surface-modified particles from which fine powder and ultrafine powder having particle diameter not larger than stated particle diameter have been removed are taken out of the surface modifying apparatus.

Toner particles that have been controlled to have a stated weight-average particle diameter, a stated particle size distribution and surface-modified to have a stated circularity are transported by a toner particle transport means 321 to the step of external addition of external additives.

The introduction area may preferably be formed at the sidewall of the main-body casing, and the fine-powder discharge area may preferably be formed at the top of the main-body casing.

As shown in FIGS. 10A and 10B, where in the top projection views of the surface modifying apparatus a straight line extending from central position S1 of the introduction pipe of the introduction area in the direction of introduction of the finely pulverized product into the first space is represented by L1, and a straight line extending from central position O1 of the fine-powder discharge pipe of the fine-powder discharge area in the direction of discharge of the fine powder and ultrafine powder by L2, an angle θ formed by the straight line L1 and straight line L2 may be from 210 to 330 degrees on the basis of the rotational direction of the classifying rotor 35. This is preferable in order to improve the yield of the toner particles.

It has been discovered that the relationship between the position of the introduction pipe for the finely pulverized product (material powder) and the position of the fine-powder discharge pipe has an influence on improving the yield of the toner particles and on remedying fogging that the obtained toner may cause. In the top projection views shown in FIGS. 10A and 10B, as viewed from the top of the surface modifying apparatus, the relationship between the central position of the material powder introduction opening 37 of the introduction pipe and the central position of the fine-powder discharge opening 45 of the fine-powder discharge pipe may preferably be as described above, i.e. where the straight line extending from central position S1 of the introduction area (introduction pipe 39) in the direction of introduction is represented by L1, the straight line extending from central position O1 of the fine-powder discharge area in the direction of discharge is represented by L2, and the angle θ formed by the straight line L1 and straight line L2 at the intersection point M1 is from 210 to 330 degrees on the basis of the rotational direction of the classifying rotor 35. In FIGS. 10A and 10B, M1 denotes the central position of the fine-powder discharge area (casing) 44. As shown in FIG. 10B, the introduction pipe for the finely pulverized product is disposed in the direction of a tangent with respect to the main-body casing 30, and the finely pulverized product is introduced in the direction of a tangent of the outer wall of the cylindrical guide ring 36. This is preferable in order to improve the classification efficiency of the finely pulverized product.

As shown in FIGS. 10A and 10B, the central position S1 of the introduction area refers to the middle point of the diameter (or width) of the introduction pipe, and the central position O1 of the fine-powder discharge area refers to the middle point of the diameter (or width) of the fine-powder discharge pipe. The angle θ refers to an angle θ formed by a straight line of S1-M2 and a straight line of O1-M2, where the point of intersection of the straight line L1 passing the middle point S1 and extending in parallel to the direction of introduction of the material powder and the straight line L2 passing the middle point O1 and extending in the direction of discharge of the fine powder is represented by M2. The angle θ is defined regarding the rotational directions of the dispersing rotor 32 and classifying rotor 35 as the regular direction. As described previously, the case of FIGS. 10A and 10B is the one in which the dispersing rotor 32 and the classifying rotor 35 rotate around M1 in the counter-clockwise direction. Where the angle θ is 180 degrees, the direction of introduction and the direction of discharge are identical and also parallel. Where the angle θ is 0 degree, the direction of introduction and the direction of discharge are opposite and also parallel.

The surface modifying apparatus of the present invention has the dispersing rotor 32, the finely pulverized product (material powder) feed area (material powder feed opening 39), the classifying rotor 35 and the fine-powder discharge area in the order from the lower side in the vertical direction. Accordingly, a drive section (such as a motor) of the classifying rotor 35 is usually provided at a further upper part of the classifying rotor 35 and a drive section of the dispersing rotor 32 is provided at a further lower part of the dispersing rotor 32. It is difficult for the surface modifying apparatus used in the present invention to feed the finely pulverized product (material powder) from the vertically upper direction of the classifying rotor 35 like TPS Classifier (manufactured by Hosokawa Micron Corporation), having only the classifying rotor 35, disclosed in, e.g., Japanese Patent Application Laid-open No. 2001-259451.

In the case of the surface modifying apparatus used in the present invention, the direction of material powder feed and the direction of fine-powder discharge may preferably be set so as to be parallel, or substantially parallel, to the rotational planes of the classifying rotor 35 and dispersing rotor 32. Where the direction of fine-powder discharge (direction of suction) is parallel, or substantially parallel, to the rotational plane of the classifying rotor 35, the angle θ formed by the direction of material powder feed and direction of fine-powder discharge is important in order to obtain particles having the stated particle diameters at a high yield. Control of the angle θ formed by the direction of material powder feed and the direction of fine-powder discharge enables agglomerated powder present in the material powder finely pulverized product to be dispersed well, and thereafter, the finely pulverized product can be led into the classification zone in the vicinity of the classifying rotor 35.

Where the angle θ is 180 degrees in the positional relationship between the finely pulverized product introduction area and the fine-powder discharge area, the suction force of the blower 364 tends to act via the classifying rotor 35 before the agglomerated powder present in the finely pulverized product is sufficiently finely dispersed by the action of the whirling currents formed by the dispersing rotor 32. This tends to make insufficient the dispersion of the finely pulverized product introduced into the first space 47, decreasing classification efficiency of the fine powder and ultrafine powder and lengthening the classification process, which results in a low classification yield. Where the angle θ is 210 to 330 degrees, a good classification yield is obtainable because the agglomerated powder present in the finely pulverized product can be sufficiently finely dispersed by the action of the whirling currents formed by the dispersing rotor 32 and the centrifugal force formed by the classifying rotor 35 can effectively act. In order to further magnify the above effect, the angle θ may preferably be from 225 to 315 degrees, and more preferably from 250 to 290 degrees.

In the present invention, the rotor end peripheral speed of the classifying rotor 35 at its part having the largest diameter may preferably be from 30 to 120 m/sec. The rotor end peripheral speed of the classifying rotor 35 may more preferably be from 50 to 115 m/sec, and still more preferably from 70 to 110 m/sec. If it is lower than 30 m/sec, the classification yield tends to decrease and the quantity of ultrafine powder present in the toner particles tends to become large, which is undesirable. If the rotor end peripheral speed is greater than 120 m/sec, a problem may arise due to the increased vibration of the apparatus.

The "surface modification" in the present invention is meant to smooth any unevenness of particle surfaces and to make the appearance and shape of particles closely spherical. To indicate the degree of surface modification of such surface-modified particles in the present invention, average circularity is used as an index of surface modification.

The average circularity in the present invention is measured with a flow type particle analyzer "FPIA-2100 Model" (manufactured by Sysmex Corporation) and is calculated using the following expressions.

$$\text{Circle-equivalent diameter} = (\text{particle projected area}/\pi)^{1/2} \times 2$$

-continued $$\text{Circularity} = \frac{\text{Circumferential length of a circle with the same area as particle projected area}}{\text{Circumferential length of particle projected image}}$$

Here, the "particle projected area" is meant to be the area of a binary-coded toner particle image, and the "circumferential length of particle projected image" is defined to be the length of a contour line formed by connecting edge points of the toner particle image. The circumferential length of a particle image in image processing at an image processing resolution of 512×512 (a pixel of 0.3 μm×0.3 μm) is used in the measurement.

The circularity referred to in the present invention is an index showing the degree of surface unevenness of toner particles. It is indicated as 1.000 when the toner particles are perfectly spherical. The more complicated the surface shape, the smaller is the value of circularity.

Average circularity C, which represents an average value of circularity frequency distribution, is calculated from the following expression, where the circularity at a partition point i of particle size distribution (a central value) is represented by ci, and the number of particles measured by m.

$$\text{Average circulatory } C = \sum_{i=1}^{m} ci/m.$$

Circularity standard deviation SD is calculated from the following expression, where the average circularity is represented by C, the circularity in each particle by ci, and the number of particles measured by m.

$$\text{Circulatory standard deviation } SD = \left(\sum_{i=1}^{m} (c - ci)^2/m\right)^{1/2}$$

The measuring instrument FPIA-2100 used in the present invention calculates the circularity of each particle and thereafter calculates the average circularity and the circularity standard deviation, where, according to circularities obtained, particles are divided into classes in which circularities from 0.4 to 1.0 are equally divided at intervals of 0.01, and the average circularity and the circularity standard deviation are calculated using the divided-point center values and the number of particles measured.

As a specific way of measuring, 20 ml of ion-exchanged water, from which impurity solid matter or the like has been removed, is made ready in a container, and a surface active agent, preferably alkylbenzenesulfonate, is added thereto as a dispersant. Thereafter, a sample for measurement is uniformly dispersed so that the sample is at a concentration of 2,000 to 5,000 particles/μl. As a means for dispersing, an ultrasonic dispersion mixer "ULTRASONIC CLEANER VS-150 Model" (manufactured by As One Corporation) is used, and the dispersion treatment is carried out for 1 minute to prepare a liquid dispersion for measurement. In that case, the liquid dispersion is appropriately cooled so that its temperature is not 40° C. or more. Also, in order to keep the circularity from scattering, the flow type particle analyzer FPIA-2100 is installed in an environment controlled to 23° C.±0.5° C., so that its in-machine temperature can be kept at 26 to 27° C., and autofocus control is performed using 2 μm latex particles at constant time intervals, preferably at 2-hour intervals.

Conditions for dispersion by ultrasonic oscillator:

Instrument: ULTRASONIC CLEANER VS-150 Model (manufactured by As One Corporation).

Rating: Output, 50 kHz, 150 W.

In measuring the circularity of particles, the above flow type particle analyzer is used and the concentration of the liquid dispersion is again controlled so that the toner concentration at the time of the measurement is 3,000 to 10,000 particles/μl, where 1,000 or more particles are measured. After the measurement, using the data obtained, the data relating to particles with a circle-equivalent diameter of less than 2 μm is cut, and the average circularity of the particles is determined.

The measuring instrument "FPIA-2100" used in the present invention is, compared with "FPIA-1000" used to calculate the shape of toner or toner particles, more precise in measuring toner particle shapes because of an improvement in magnification of processed particle images and also an improvement in processing resolution of images captured (256×256→512×512). Therefore, a better capture of finer particles was achieved. Accordingly, where the particle shapes must more accurately be measured as in the present invention, FPIA-2100 is more useful.

The summary of the measurement in the present invention is as follows.

The sample dispersion is passed through channels (extending along the flow direction) of a flat and depressed flow cell (thickness: about 200 μm). A strobe and a CCD (charge-coupled device) camera are fitted so as to be positioned opposite to each other with respect to the flow cell to form a light path that passes crosswise with respect to the thickness of the flow cell. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-equivalent diameter. The circularity of each particle is calculated from the projected area of the two-dimensional image of each particle and from the circumferential length of the projected image according to the above equation for calculating the circularity.

As shown in FIG. 8, the finely pulverized product may be obtained by finely pulverizing a coarsely pulverized product of a cooled product of a melt-kneaded product by means of an impact air grinding machine or a mechanical grinding machine, followed by classification. The mechanical grinding machine may include Turbo Mill, manufactured by Turbo Kogyo Co., Ltd.; Criptron, manufactured by Kawasaki Heavy Industries, Ltd; Inomizer, manufactured by Hosokawa Micron Corporation; and Super Rotor, manufactured by Nisshin Engineering Inc.

Figure 7:
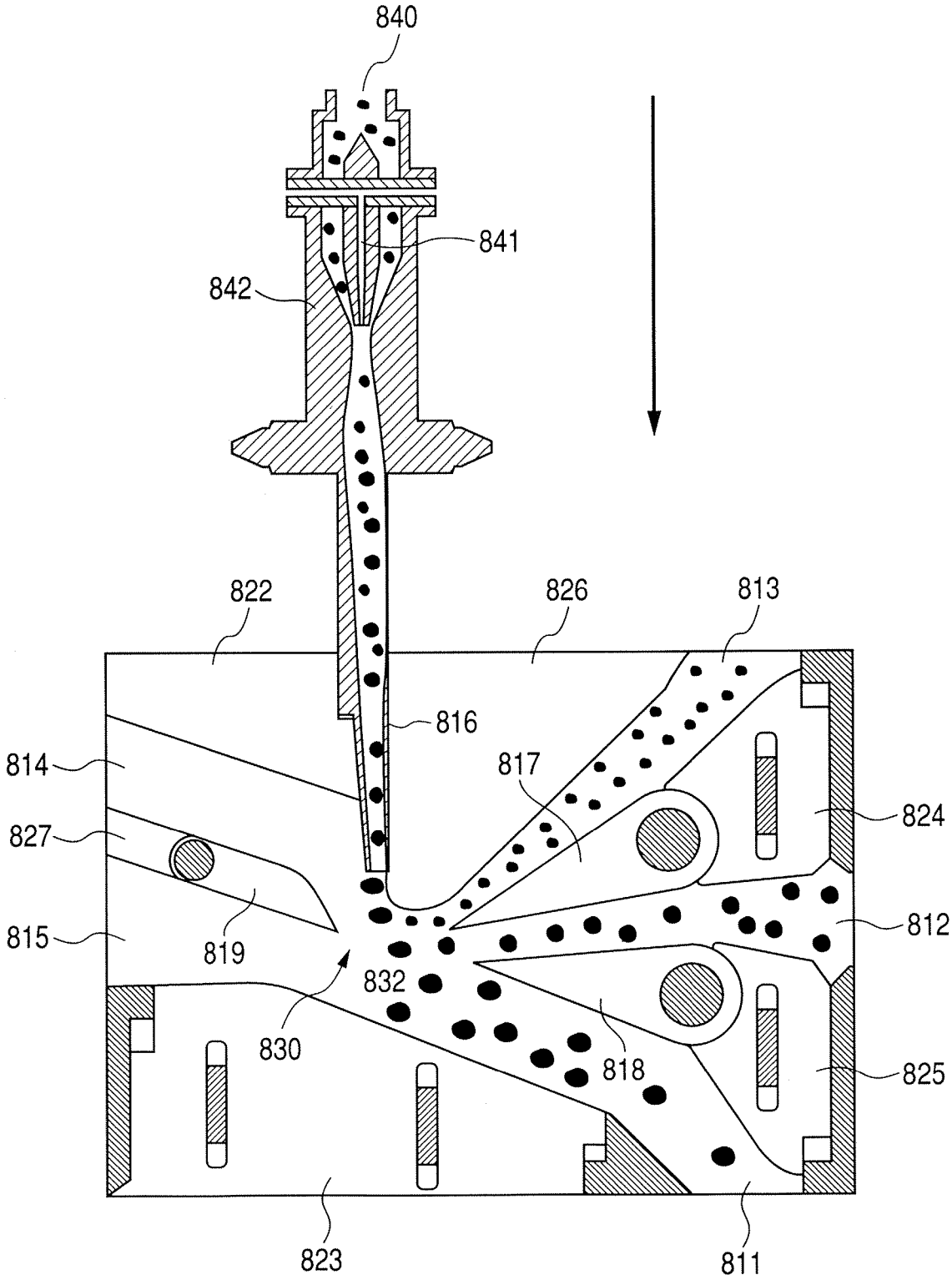
FIG. 7 is a schematic sectional view of another classifier used in the classification step.

Preferable methods for obtaining the finely pulverized product in the present invention may also include a method in which the finely pulverized product is obtained using an I-DS grinding machine (manufactured by Nippon Pneumatic MFG Co., Ltd.), an impact air grinding machine employing jet air, as disclosed in FIG. 1 of Japanese Patent Application Laid-open No. 2003-262981, and a classifier disclosed in FIG. 7 of Japanese Patent Application Laid-open No. 2003-262981.

According to the toner production process of the present invention, the surface-modified particles obtained through the surface modification step can have an average circularity that is larger by 0.01 to 0.40 than the average circularity of the finely pulverized product led into the step of surface modification. This is because the surface shape of toner particles can be controlled as desired by controlling, as desired, the surface modification time in the surface modifying apparatus. Toner particles (surface-modified particles) having an average circularity from 0.935 to 0.980 can be obtained by using this apparatus. From the viewpoint of improving transfer efficiency and preventing hollow characters from appearing in images, the average circularity is preferably from 0.940 to 0.980.

Particle size distribution of the toner may be measured by various methods. In the present invention, it is measured using the following measuring instrument.

Coulter Counter TA-II Model or Coulter Multisizer, manufactured by Coulter Electronics, Inc., is used as the measuring instrument. Its aperture is 100 μm. The volume and number of toner particles are measured, and volume distribution and number distribution are calculated. Then, the weight-base, weight average particle diameter according to the present invention, determined from the volume distribution, is determined.

The toner produced by the production process of the present invention has toner particles (toner base particles) containing at least a binder resin and a colorant, and an external additive(s) optionally added to and mixed with the toner particles (toner base particles).

Raw materials of the toner particles are described below. The toner particles contain at least a binder resin and a colorant, and optionally further contain components, such as a wax and a charge control agent.

As the binder resin used in the present invention, usable are resins conventionally known as binder resins for toners as exemplified by vinyl resins, phenol resins, natural resin modified phenol resins, natural resin modified maleic acid resins, acrylic resins, methacrylic resins, polyvinyl acetate resins, silicone resins, polyester resins, polyurethane resins, polyamide resins, furan resins, epoxy resins, xylene resins, polyvinyl butyral resins, terpene resins, cumarone indene resins, and petroleum resins. In particular, vinyl resins and polyester resins are preferred in view of chargeability and fixing performance.

The vinyl resins may include polymers with vinyl monomers including styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins, such as ethylene, propylene, butylene and isobutylene; unsaturated polyenes, such as butadiene; vinyl halides, such as vinyl chloride, vinylidene chloride, vinyl bromide and vinyl fluoride; vinyl esters, such as vinyl acetate, vinyl propionate and vinyl benzoate; α-methylene aliphatic monocarboxylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers, such as methyl vinyl ether, ethyl vinyl ether and isobutyl vinyl ether; vinyl ketones, such as methyl vinyl ketone, hexyl vinyl ketone and methyl isopropenyl ketone; N-vinyl compounds, such as N-vinylpyrrole, N-vinylcarbazole, N-vinylindole and N-vinylpyrrolidone; vinylnaphthalenes; acrylic acid or methacrylic acid derivatives, such as acrylonitrile, methacrylonitrile and acrylamide; esters of α,β-unsaturated acids and diesters of dibasic acids; acrylic acids or α- or β-alkyl derivatives thereof, such as acrylic acid, methacrylic acid, α-ethylacrylic acid, crotonic acid, cinnamic acid, vinylacetic acid, isocrotonic acid and angelic acid; unsaturated dicarboxylic acids, such as fumaric acid, maleic acid, citraconic acid, alkenylsuccinic acids, itaconic acid, mesaconic acid, dimethylmaleic acid and dimethylfumaric acid, and monoester derivatives or anhydrides of these.

In these vinyl resins, the monomer as listed above may be used alone or in combination of two or more types of monomers. Combinations of monomers that may form styrene copolymers or styrene-acrylic copolymers are preferred.

The binder resin used in the present invention may also optionally be a polymer or copolymer cross-linked with a cross-linkable monomer as exemplified below.

As the cross-linkable monomer, a monomer having two or more polymerizable double bonds may be used. As the cross-linkable monomer of such a type, various monomers as shown below are known in the art and may preferably be used in the toner produced by the process of the present invention.

As a monofunctional monomer among cross-linkable monomers, there may be used aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds in which an acrylate moiety has been replaced with a methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds in which the acrylate moiety has been replaced with a methacrylate; diacrylate compounds linked with a chain containing an aromatic group and an ether linkage, as exemplified by polyoxyethylene(2)-2,2-bis(4-hydroxyphenyl)propane diacrylate, polyoxyethylene(4)-2,2-bis(4-hydroxyphenyl)propane diacrylate, and the above compounds in which the acrylate moiety has been replaced with a methacrylate; and also polyester type diacrylate compounds, as exemplified by MANDA (trade name; available from Nippon Kayaku Co., Ltd.).

As a polyfunctional cross-linkable monomer, there may be used pentaerythritol acrylate, trimethylolethane triacrylate, trimethylolpropane triacrylate, tetramethylolpropane triacrylate, tetramethylolmethane tetraacrylate, oligoester acrylate, and the above compounds whose acrylate moiety has been replaced with methacrylate; triallylcyanurate, and triallyltrimellitate.

A polyester resin shown below is also preferred as the binder resin. In the polyester resin, from 45 to 55 mol % of all components are held by an alcohol component and from 55 to 45 mol % by an acid component.

As the alcohol component, there may be used ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (B):

(B)

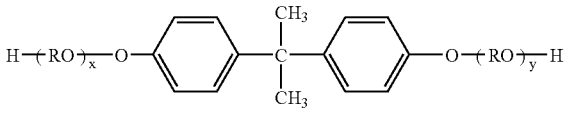

wherein R represents an ethylene group or a propylene group, x and y are each an integer of 0 or more, and an average value of x+y is 2 to 10;

and a diol represented by the following Formula (C):

(C)

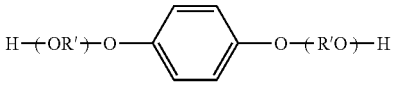

wherein R' represents $CH_2CH_2$—,

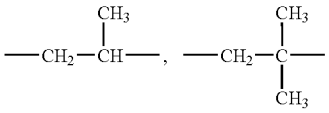

or polyhydric alcohols such as glycerol, sorbitol and sorbitan.

As the acid component, a carboxylic acid is preferred. As a dibasic acid component, there may be used benzene dicarboxylic acids or anhydrides thereof, such as phthalic acid, terephthalic acid, isophthalic acid and phthalic anhydride; alkyldicarboxylic acids, such as succinic acid, adipic acid, sebacic acid and azelaic acid, or anhydrides thereof; unsaturated dicarboxylic acids, such as fumaric acid, maleic acid, citraconic acid and itaconic acid, or anhydrides thereof. As a tribasic or higher carboxylic acid, it may include trimellitic acid, pyromellitic acid, benzophenonetetracarboxylic acid, or anhydrides thereof.

A particularly preferred alcohol component of the polyester resin is the bisphenol derivative represented by the above Formula (B). As a particularly preferred acid component thereof, it may include dicarboxylic acids, such as phthalic acid, terephthalic acid, isophthalic acid, or anhydrides thereof, succinic acid, n-dodecenylsuccinic acid or anhydrides thereof, fumaric acid, maleic acid and maleic anhydride; and tricarboxylic acids, such as trimellitic acid or anhydrides thereof. The reason therefor is that a toner in which the polyester resin obtained from these acid component and alcohol component are used as the binder resin has good fixing performance and superior anti-offset properties as a toner for heat roller fixing.

Where the toner is a magnetic toner, it includes a magnetic material with no particular limitations, as long as it is a material that is typically used. For example, it may include iron oxides, such as magnetite, maghemite and ferrite, and iron oxides including other metal oxides; metals, such as Fe, Co and Ni, or alloys of any of these metals with any of the metals, such as Al, Co, Cu, Pb, Mg, Ni, Sn, Zn, Sb, Be, Bi, Cd, Ca, Mn, Se, Ti, W and V, and mixtures of any of these.

The magnetic material may specifically include triiron tetraoxide ($Fe_3O_4$), iron sesquioxide ($\gamma$-$Fe_2O_3$), yttrium iron oxide ($Y_3Fe_5O_{12}$), cadmium iron oxide ($CdFe_2O_4$), gadolinium iron oxide ($Gd3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), lanthanum iron oxide ($LaFeO_3$), iron powder (Fe), cobalt powder (Co) and nickel powder (Ni). Any of the above magnetic materials may be used alone or in combination of two or more types. A particularly preferred magnetic material is a fine powder of triiron tetraoxide or y-iron sesquioxide.

These magnetic materials may be those having an average particle diameter from 0.05 to 2 μm, a coercive force from 1.6 to 12.0 kA/m, a saturation magnetization from 50 to 200 $Am^2/kg$ (preferably from 50 to 100 $Am^2/kg$), and a residual magnetization from 2 to 20 $Am^2/kg$, as magnetic properties under the application of a magnetic field of 795.8 kA/m, which is preferable especially when used in electrophotographic image forming methods. Also, any of these magnetic materials may be incorporated in an amount from 60 to 200 parts by weight, and more preferably from 80 to 150 parts by weight, based on 100 parts by weight of the binder resin.

As the colorant, a non-magnetic colorant may also be used. Such a non-magnetic colorant may include any suitable pigments and dyes. For example, the pigments include carbon black, Aniline Black, acetylene black, Naphthol Yellow, Hanza Yellow, Rhodamine Lake, red iron oxide, Phthalocyanine Blue and Indanthrene Blue. Any of these may be added in an amount from 0.1 to 20 parts by weight, and preferably from 1 to 10 parts by weight, based on 100 parts by weight of the binder resin. The dyes are likewise usable and may be added in an amount from 0.1 to 20 parts by weight, and preferably from 0.3 to 10 parts by weight, based on 100 parts by weight of the binder resin.

Carbon black and colorants toned in black by the use of yellow, magenta, and cyan colorants shown below are usable as non-magnetic black colorants.

As yellow colorants, compounds typified by condensation azo compounds, isoindolinone compounds, anthraquinone compounds, azo metal complexes, methine compounds, and allylamide compounds may be used. Stated specifically, C.I. Pigment Yellow 12, 13, 14, 15, 17, 62, 74, 83, 93, 94, 95, 97, 109, 110, 111, 120, 127, 128, 129, 147, 168, 174, 176, 180, 181 and 191 may preferably be used.

As magenta colorants, condensation azo compounds, diketopyrrolopyrrole compounds, anthraquinone compounds, quinacridone compounds, basic dye lake compounds, naphthol compounds, benzimidazolone compounds, thioindigo compounds and perylene compounds may be used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferred.

As cyan colorants, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may particularly preferably be used.

The toner in the present invention may further contain a wax. As the wax used in the present invention, various waxes conventionally known as release agents may be used, which may include for example, as hydrocarbon waxes, aliphatic hydrocarbon waxes, such as low-molecular weight polyethylene, low-molecular weight polypropylene, polyolefin copolymers, polyolefin wax, microcrystalline wax, paraffin wax and Fischer-Tropsh wax.

As a wax having a functional group, there may be used oxides of aliphatic hydrocarbon waxes, such as polyethylene oxide wax; or block copolymers of these; vegetable waxes, such as candelilla wax, carnauba wax, Japan wax (haze wax)

and jojoba wax; animal waxes, such as bees wax, lanolin and spermaceti; mineral waxes, such as ozokelite, serecin and petrolatum; waxes composed chiefly of a fatty ester, such as montanate wax and castor wax; and those obtained by subjecting a part or the entire fatty ester to deoxidation, such as deoxidized carnauba wax.

The wax may further include saturated straight-chain fatty acids, such as palmitic acid, stearic acid, montanic acid and also long-chain alkylcarboxylic acids having a long-chain alkyl group; unsaturated fatty acids, such as brassidic acid, eleostearic acid and parinaric acid; saturated alcohols such as stearyl alcohol, eicosyl alcohol, behenyl alcohol, carnaubyl alcohol, ceryl alcohol, melissyl alcohol and also alkyl alcohols having a long-chain alkyl group; polyhydric alcohols, such as sorbitol; fatty acid amides, such as linolic acid amide, oleic acid amide and lauric acid amide; saturated fatty bisamides, such as methylenebis(stearic acid amide), ethylenebis (capric acid amide), ethylenebis(lauric acid amide) and hexamethylenebis(stearic acid amide); unsaturated fatty acid amides, such as ethylenebis(oleic acid amide), hexamethylenebis(oleic acid amide), N,N'-dioleyladipic acid amide and N,N'-dioleylsebasic acid amide; aromatic bisamides, such as m-xylenebisstearic acid amide and N,N'-distearylisophthalic acid amide; fatty acid metal salts (those commonly called metallic soap), such as calcium stearate, calcium laurate, zinc stearate and magnesium stearate; partially esterified products of polyhydric alcohols with fatty acids, such as monoglyceride behenate; and methyl esterified compounds having a hydroxyl group, obtained by hydrogenation of vegetable fats and oils.

A wax grafted with a vinyl monomer may also be used in the toner in the present invention. Such a wax may include waxes obtained by grafting aliphatic hydrocarbon waxes with vinyl monomers, such as styrene or acrylic acid.

Waxes preferably usable may include polyolefins obtained by radical-polymerizing olefins under high pressure; polyolefins obtained by purifying low-molecular-weight by-products formed at the time of the polymerization of high-molecular-weight polyolefins; polyolefins obtained by polymerization under low pressure in the presence of a catalyst, such as a Ziegler catalyst or a metallocene catalyst; polyolefins obtained by polymerization utilizing radiation, electromagnetic waves or light; paraffin wax, microcrystalline wax, and Fischer-Tropsh wax; synthetic hydrocarbon waxes obtained by the Synthol method, the Hydrocol process or the Arge process; synthetic waxes composed, as a monomer, of a compound having one carbon atom; hydrocarbon waxes having a functional group, such as a hydroxyl group or a carboxyl group; mixtures of hydrocarbon waxes and waxes having a functional group; and modified waxes obtained by graft-modifying any of these waxes serving as a matrix, with vinyl monomers, such as styrene, maleate, acrylate, methacrylate or maleic anhydride.

Also, preferably used are waxes with a narrow molecular weight distribution made by press sweating, solvent fractionation, recrystallization, vacuum distillation, ultracritical gas extraction or molten liquid crystallization, and those from which low-molecular-weight solid fatty acids, low-molecular-weight solid alcohols, low-molecular-weight solid compounds and other impurities have been removed.

In order to further stabilize toner chargeability, a charge control agent may optionally be used. The charge control agent may be used in an amount from 0.1 to 10 parts by weight, and preferably from 1 to 5 parts by weight, based on 100 parts by weight of the binder resin. This is preferable in order to control chargeability of the toner.

As the charge control agent, various conventionally known charge control agents may be used, which include, e.g., the following.

Effective charge control agents that are capable of providing the toner with the ability to be negatively charged include, for example, organic metal complex salts and chelate compounds, including monoazo metal complexes, acetylacetone metal complexes, aromatic hydroxycarboxylic acid metal complexes and aromatic dicarboxylic acid type metal complexes. Charge control agents may also be aromatic hydroxycarboxylic acids, aromatic mono- and polycarboxylic acids, and metal salts, anhydrides or esters thereof and phenol derivatives, such as bisphenol. Preferred are monoazo metal compounds, which may include Cr, Co or Fe metal complex compounds of monoazo dyes synthesized from phenols or naphthols having as a substituent an alkyl group, a halogen atom, a nitro group, a carbamoyl group or the like. Metal compounds of aromatic carboxylic acids may also preferably be used, which may include metal compounds of carboxylic acids, hydroxycarboxylic acids or dicarboxylic acids of benzene, naphthalene, anthracene or phenanthrene, having an alkyl group, a halogen atom or a nitro group.

In particular, azo type metal complexes represented by the following formula (1) are preferred.

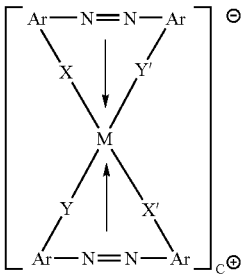

(1)

In the formula, M represents a central coordinating metal, including Sc, Ti, V, Cr, Co, Ni, Mn or Fe. Ar represents an aryl group, including an aryl group, such as a phenyl group or a naphthyl group, which may have a substituent. In such a case, the substituent may include a nitro group, a halogen atom, a carboxyl group, an anilide group, and an alkyl group having 1 to 18 carbon atoms or an alkoxyl group having 1 to 18 carbon atoms. X, X', Y and Y' each represent —O—, —CO—, —NH— or —NR— (R is an alkyl group having 1 to 4 carbon atoms). $C^+$ represents a counter ion, which may be a hydrogen ion, a sodium ion, a potassium ion, an ammonium ion or an aliphatic ammonium ion, or a mixed ion of any of these.

In the above formula (1), as the central metal, Fe is particularly preferred. As the substituent, a halogen atom, an alkyl group or an anilide group is preferred. As the counter ion, a hydrogen ion, an alkali metal ion, an ammonium ion or an aliphatic ammonium ion is preferred. A mixture of complexes having different counter ions may also preferably be used.

Basic organic acid metal complexes represented by the following formula (2) are also preferable as charge control agents capable of imparting negative chargeability.

(2)

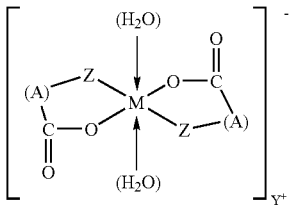

In the formula, M represents a central coordinating metal, including Cr, Co, Ni, Fe, Zn, Al, Si or B;

A represents:

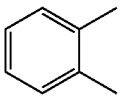

(which may have a substituent such as an alkyl group)

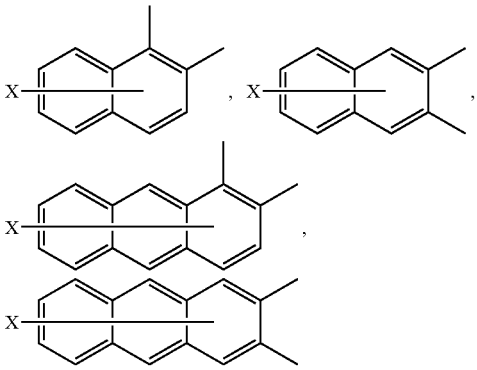

(X represents a hydrogen atom, a halogen atom, a nitro group or an alkyl group), and

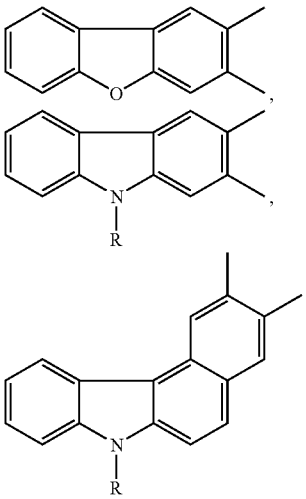

(R represents a hydrogen atom, an alkyl group having 1 to 18 carbon atoms or an alkenyl group having 2 to 18 carbon atoms);

$Y^+$ represents a counter ion, which includes a hydrogen ion, a sodium ion, a potassium ion, an ammonium ion, an aliphatic ammonium ion, or a mixed ion of any of these. Z represents —O— or

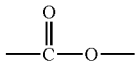

A charge control agent that is capable of providing the toner with the ability to be positively charged may include Nigrosine, Nigrosine derivatives, triphenylmethane compounds and organic quaternary ammonium salts. For example, it may include Nigrosine and products modified with a fatty acid metal salt; quaternary ammonium salts, such as tributylbenzylammonium 1-hydroxy-4-naphtholsulfonate and tetrabutylammonium tetrafluoroborate, and analogues of these, i.e., onium salts, such as phosphonium salts, and lake pigments of these, triphenylmethane dyes and lake pigments of these (lake-forming agents include tungstophosphoric acid, molybdophosphoric acid, tungstomolybdophosphoric acid, tannic acid, lauric acid, gallic acid, ferricyanides and ferrocyanides); and metal salts of higher fatty acids. Any of these may be used alone or in combination of two or more types.

Of these, triphenylmethane compounds and quaternary ammonium salts, the counter ions of which are not halogens, may preferably be used.

Homopolymers of monomers represented by the following formula (3):

(3)

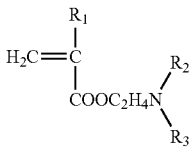

wherein $R_1$ represents a hydrogen atom or a methyl group; $R_2$ and $R_3$ each represents a substituted or unsubstituted alkyl group (preferably having 1 to 4 carbon atoms);

or copolymers of polymerizable monomers, such as styrene, acrylates or methacrylates as described above, may also be used as positive charge control agents. In this case, these charge control agents also function as binder resins.

In particular, compounds represented by the following formula (4) are preferred as charge control agents in the present invention:

(4)

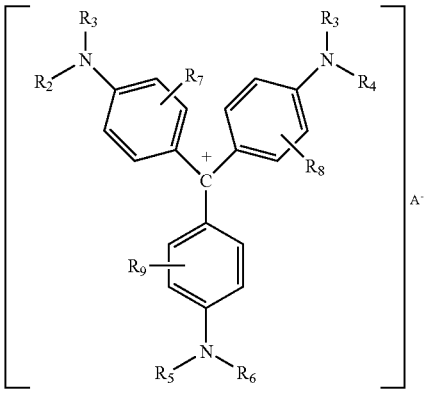

wherein $R_1$, $R_2$, $R_3$, $R_4$, $R_1$ and $R_6$ may be the same or different from one another and each represents a hydrogen atom, a substituted or unsubstituted alkyl group or a substituted or unsubstituted aryl group; $R_7$, $R_8$ and $R_9$ may be the same or different from one another and each represents a hydrogen atom, a halogen atom, an alkyl group or an alkoxyl group; and A represents a negative ion, such as a sulfate ion, a nitrate ion, a borate ion, a phosphate ion, a hydroxide ion, an organic sulfate ion, an organic sulfonate ion, an organic phosphate ion, a carboxylate ion, an organic borate ion, or tetrafluorborate.

As methods for incorporating the charge control agent with the toner, available are a method of adding the charge control agent internally to toner particles and a method of adding it externally to toner particles. The amount of the charge control agent used depends on the type of the binder resin, the presence or absence of any other additives, and the manner by which the toner is produced, including the manner of dispersion, and cannot be absolutely specified. Preferably, the charge control agent may be used in an amount ranging from 0.1 to 10 parts by weight, and more preferably from 0.1 to 5 parts by weight, based on 100 parts by weight of the binder resin.

The toner produced by the process of the present invention may optionally contain, in addition to the toner particles, an external additive(s) for controlling the fluidity, chargeability, and so forth, of the toner. As the external additive(s), a fluidity improver may be added to the toner. The fluidity improver is an agent that can improve the fluidity by its external addition to toner particles (toner base particles), as seen in comparison before and after its addition. For example, it may include fluorine resin powders, such as fine vinylidene fluoride powder; fine powdery silica, such as wet-process silica and dry-process silica; fine titanium oxide powder; fine alumina powder; and treated fine powders obtained by subjecting these to a surface treatment with a silane compound, a titanium coupling agent or a silicone oil.

The powder may be made hydrophobic by a chemical treatment with an organosilicon compound or the like capable of reacting with or being physically adsorbed on fine powders.

The organosilicon compound includes hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals. It may further include silicone oils, such as dimethylsilicone oil. Any of these may be used alone or in the form of a mixture of two or more types.

As external-additive particles used in the present invention, which may be from 0.1 μm to 5.0 μm in particle diameter, usable are inorganic fine particles, organic fine particles, and mixtures or composites of these particles. Stated specifically, they may include powders of metal oxides, such as strontium titanate, cerium oxide, aluminum oxide, and magnesium oxide, as well as fluorine resin powders and fine resin powders. In particular, strontium titanate and cerium oxide are preferred in view of charge characteristics.

The toner production process of the present invention is described using as an example a case in which the toner is produced using such constituent materials and external additives as described above. As described previously, the toner production process of the present invention has the step of producing toner material powder particles containing at least the binder resin and the colorant and the step of treating the toner material powder particles for their surface modification by means of the surface modifying apparatus to obtain toner particles. In the present invention, the "toner material powder particles" refer to untreated toner particles (material powder particles) that have not been treated for the surface modification, in contrast with toner particles having been treated for the surface modification (surface-modified particles) by the surface modifying apparatus of the present invention. Also, in the present invention, "treating toner particles (particles being treated)" refer to toner material powder particles (material powder particles) that are being classified and treated for surface modification in the surface modifying apparatus of the present invention. Treating toner particles (particles being treated) on which the stated treatment has been completed in the surface modifying apparatus are discharged out of the apparatus as the toner particles (surface-modified particles).

As the step of producing the toner material powder particles, a step may be used in which toner particles are produced by a conventionally known method, such as pulverization or polymerization, without any particular limitations. However, in view of an advantage that the effect of the surface modification treatment by the surface modifying apparatus is maximized, the step may preferably be the step of producing toner particles by what is called pulverization, having the step of melt-kneading a composition containing at least the binder resin and the colorant to obtain a kneaded product, and the step of cooling and solidifying the kneaded product obtained and finely pulverizing the cooled and solidified product by means of an impact air grinding machine or a mechanical grinding machine to obtain the finely pulverized product as the toner material powder particles.

A process for producing the toner material powder particles by pulverization is described below. At least the resin and the colorant are weighed and compounded as toner internal additives in stated quantities and then mixed (this is called "raw-material mixing step"). Examples of a mixer for this process include a Double Cone Mixer, a V-type mixer, a drum type mixer, a Super mixer, a Henschel mixer and a Nauta mixer.

Further, the toner raw materials (composition) compounded and mixed in the above step are melt-kneaded to melt resins and disperse the colorant contained therein (this is called "melt-kneading step"). In the melt kneading step, batch-wise kneaders, such as a pressure kneader and a Banbury mixer, or continuous type kneaders may be used in that melt-kneading step. In recent years, single-screw or twin-screw extruders are prevailingly used because they advantageously enable continuous production. For example, commonly used are a KTK type twin-screw extruder manufactured by Kobe Steel, Ltd., a TEM type mixer manufactured by Toshiba Machine Co., Ltd.), a twin-screw extruder manufactured by KCK Co., and a co-kneader manufactured by Coperion Buss Ag. A colored resin composition as the kneaded product obtained by melt-kneading the toner raw materials is, after melt-kneading, rolled out by means of a twin-roll mill, followed by cooling through a cooling step where the kneaded product is cooled.

The cooled product of the colored resin composition thus obtained is subsequently pulverized in the pulverization step into a product having the desired particle diameter. In the pulverization step, the cooled colored resin composition is coarsely pulverized by means of a crusher, a hammer mill or a feather mill, and is further finely pulverized by means of an impact air grinding machine, such as Counter Jet Mill (manufactured by Hosokawa Micron Corporation), Micron Jet T-Model (manufactured by Hosokawa Micron Corporation), Cross Jet Mill (manufactured by Kurimoto, Ltd.); an IDS type mill and PJM Jet Grinding Mill (manufactured by Nippon Pneumatic MFG Co., Ltd.) or Scrum Jet Mill (manufactured by Tokuju Corporation), or a mechanical grinding machine, such as the Inomizer (manufactured by Hosokawa Micron Corporation), Criptron (manufactured by Kawasaki Heavy Industries, Ltd), Super Rotor (manufactured by Nisshin Engineering Inc.), Turbo Mill (manufactured by Turbo Kogyo Co., Ltd.) or Tornado Mill (manufactured by Nikkiso Co., Ltd.). In the pulverization step, the colored resin composition is pulverized stepwise in this manner to form a product having the desired toner particle size.

Figure 5:
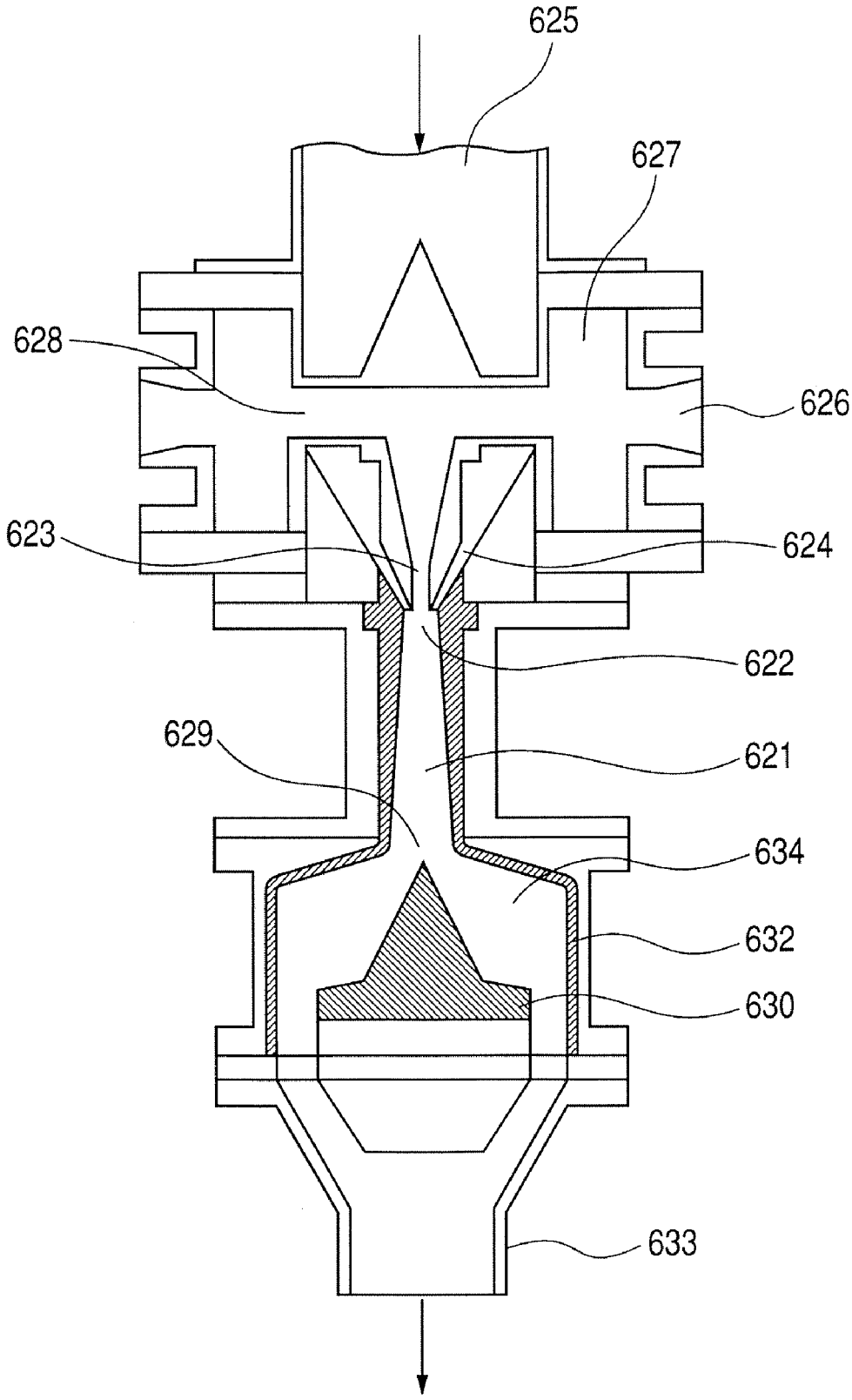
FIG. 5 is a schematic sectional view of an example of an impact air pulverizer used in the step of fine pulverization in which a kneaded product is cooled and a coarsely pulverized product of the kneaded solidified product is finely pulverized.

A grinding machine shown in FIG. 5 may be used as a preferable impact air grinding machine.

In the impact air grinding machine shown in FIG. 5, a pulverizing product fed from a pulverizing product feed cylinder 625 reaches a pulverizing product feed opening 624 formed between i) the inner wall of an accelerating pipe throat portion 622 of an accelerating pipe 621 the axis of which is provided in the vertical direction and ii) the outer wall of a high-pressure gas feed nozzle 623 the center of which is on the axis of the accelerating pipe 621. Meanwhile, high-pressure gas is led in through a high-pressure gas feed opening 626, passes a single or preferably a plurality of high-pressure gas lead-in pipe(s) 628 via a high-pressure gas chamber 627, and spouts from high-pressure gas feed nozzle 623 while expanding toward an accelerating pipe outlet 629. At this point, in view of the ejector effect produced in the vicinity of the accelerating pipe throat portion 622, the pulverizing product is, while being accompanied by the gas present together therewith, sucked from the pulverizing product feed opening 624 toward the accelerating pipe outlet 629 and fed through the upper-end periphery of the accelerating pipe 621 into the accelerating pipe, where it rapidly accelerates while being uniformly mixed with the high-pressure gas at the accelerating pipe throat portion 622 and collides against the collision face of a collision member 630 in a pulverizing chamber 634 provided opposite to the accelerating pipe outlet 629, in the state of a uniform solid-gas mixed air stream without any uneven dust concentration. The pulverizing product is also pulverized by its collision against a pulverizing chamber inner wall 632. The finely pulverized pulverizing product is discharged out of the pulverizing chamber 634 through a pulverized product discharge opening 633.

The pulverized product as the toner material powder particles, obtained in the pulverization step, is further treated to be made spherical in the step of surface modification to obtain the surface-modified particles. In the present invention, the surface-modified particles thus obtained may be used as toner particles. Also, after the pulverized product has undergone the surface modification step, the surface-modified particles may optionally further undergo the step of classification to obtain toner particles, the classification being carried out using an air classifier, such as Elbow Jet (manufactured by Nittetsu Mining Co., Ltd.), which is of an inertial classification system, or Turboplex (manufactured by Hosokawa Micron Corporation), which is of a centrifugal classification system, or a sifting machine, such as High Bolter (manufactured by Shin Tokyo Kikai K.K.), which is a wind sifter. Also, the classification step may be set prior to the surface modification step.

Figure 6:
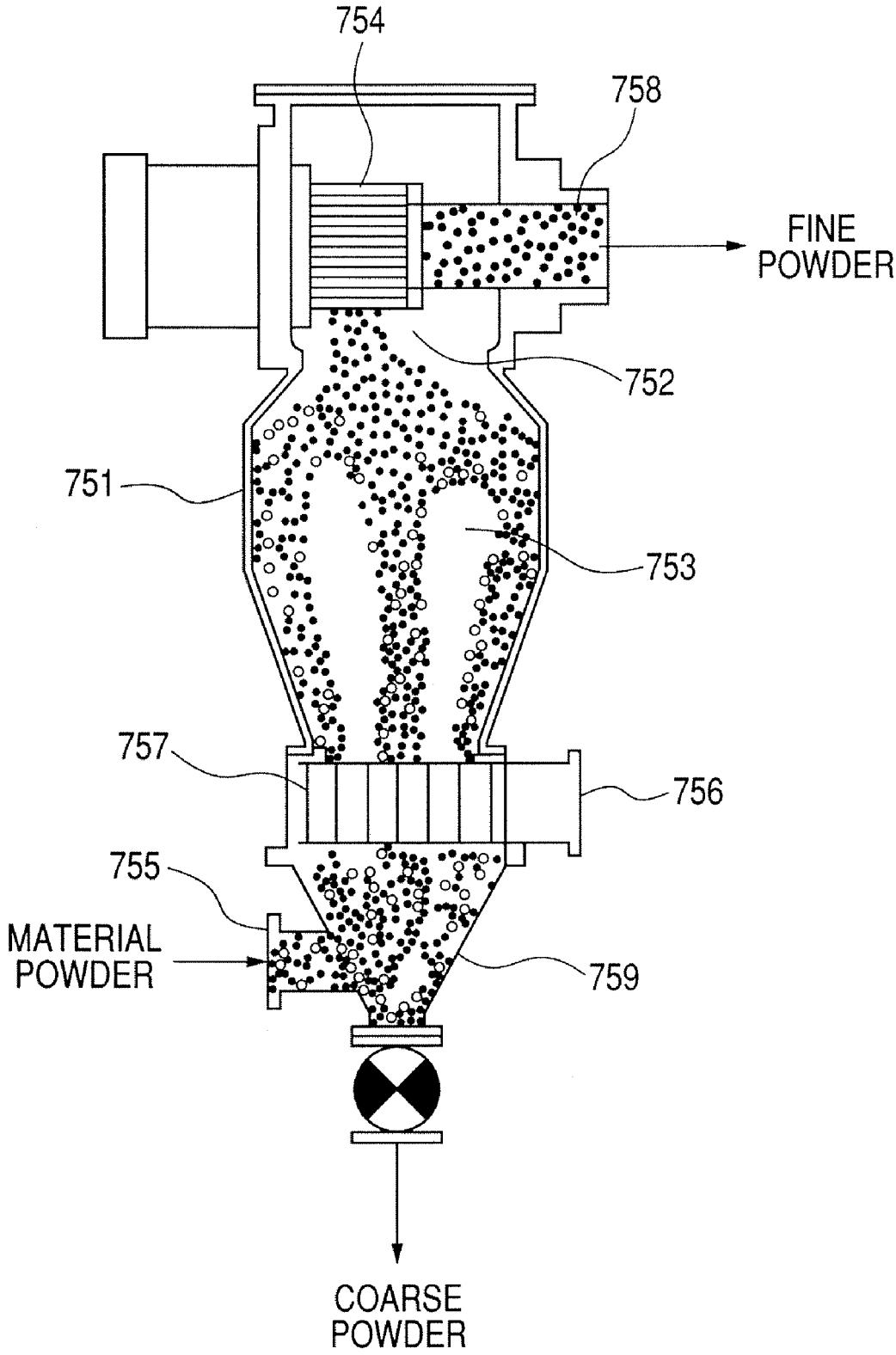
FIG. 6 is a schematic sectional view of a classifier used in the classification step.

A rotary air classifier shown in FIG. 6 may be a rotary air classifier having preferable construction.

In FIG. 6, a classifying chamber 752 is formed in the interior of a main-body casing 751, and a guide chamber 753 is provided at the lower part of this classifying chamber 752. The rotary air classifier shown in FIG. 6 is a separate drive system classifier, which generates forced whirls that utilize centrifugal force, in the classifying chamber 752 to carry out classification into coarse powder and fine powder. A classifying rotor 754 is provided in the classifying chamber 752, where a material powder and air, which have been sent into the guide chamber 753, are let to whirlingly flow into the classifying chamber 752 by suction acting between blades of the classifying rotor 754. The material powder is introduced through a material powder introduction opening 755, and the air is taken in through an air introduction opening 756 and further through the material powder introduction opening 755 together with the material powder. The material powder is carried together with inflowing air to the guide chamber 752 via a dispersing louver 757. The air and material powder, which stand fluidized inside the classifying chamber 752 through the material powder introduction opening 755, are uniformly distributed to the individual blades of the classifying rotor 754, and this is preferable for the material powder to be classified with a good precision. The flow path extending to reach the classifying rotor 754 may preferably have a shape that prevents the concentration from easily taking place.

The blades of the classifying rotor 754 are movable, and blade spaces of the classifying rotor 754 are adjustable as desired. The speed of the classifying rotor 754 is controlled through a frequency converter. A fine-powder discharge pipe 758 is connected to a suction fan via fine-powder collecting means, such as a cyclone and a dust collector, and a suction force is applied to the classifying chamber 752 by operating the suction fan.

The material powder flowed into the classifying chamber 752 is dispersed by the high-speed rotating, classifying rotor 754, and is centrifugally separated into coarse powder and fine powder by a centrifugal force acting on each particle. The coarse powder in the classifying chamber 752 passes a hopper 759 for coarse powder discharge, which is connected to the lower part of the main-body casing 751, and is discharged out of the classifier through a rotary valve.

A classifier shown in FIG. 7 may used as another preferred classifier.

As shown in FIG. 7, a sidewall 822 and a G-block 823 form a part of a classifying chamber, and classifying edge blocks 824 and 825 have classifying edges 817 and 818, respectively. The G-block 823 can slide to right and to the left for its setting position. Also, the classifying edges 817 and 818 are swing-movable around their shafts. Thus, the tip position of each classifying edge can be changed by the swinging of the classifying edge. The respective classifying edge blocks 824 and 825 are set up so that their locations can be slid right and left. As they are slid, the corresponding knife-edge type classifying edges 817 and 818 are also slid right and left. These classifying edges 817 and 818 divide a classification zone of the classifying chamber 832 into three sections.

A material powder feed nozzle 816 having at its rearmost-end part a material powder feed opening 840 for introducing a material powder therethrough, having at its rear-end part a high-pressure air nozzle 841 and a material powder guide nozzle 842, and also having an orifice in the classifying chamber 832 is provided on the right side of the sidewall 822. A Coanda block 826 is disposed along an extension of the lower tangential line of the material powder feed nozzle 816 so as to form a long elliptic arc. The classifying chamber 832 has a left-part block 827 provided with a knife edge-shaped air-intake edge 819 extending in the right-side direction of the classifying chamber 832 and further provided with air-intake pipes 814 and 815 on the left side of the classifying chamber 832, which open to the classifying chamber 832.

The locations of the classifying edges 817 and 818, G-block 823, and the air-intake edge 819 are adjusted according to the type of the toner particles, the material powder to be classified, and also according to the desired particle size.

At the bottom, sidewall, and top of the classifying chamber 832, discharge outlets 811, 812, and 813, respectively, which open to the classifying chamber, are provided corresponding to the respective divided zones. The discharge outlets 811, 812, and 813 are connected with communicating means, such as pipes, and may respectively be provided with shutter means, such as valve means.

The material powder feed nozzle 816 comprises a rectangular pipe section and a pyramidal pipe section, and the ratio of the inner diameter of the rectangular pipe section to the inner diameter of the narrowest part of the pyramidal pipe section may be set from 20:1 to 1:1, and preferably from 10:1 to 2:1, to obtain a good feed velocity.

The classification in the multi-division classifying zone constructed as described above is operated, for example, in the following way. The inside of the classifying chamber is evacuated through at least one of the discharge outlets 811, 812, and 813. The material powder is jetted and dispersed into the classifying chamber 832 through the material powder feed nozzle 816 at a flow velocity of preferably from 10 to 350 m/second, utilizing the gas stream flowing at a reduced pressure through the inside of the material powder feed nozzle 816 opening into the classifying chamber 832 and utilizing the ejector effect of compressed air jetted from the high-pressure air nozzle 841.

The particles in the material powder fed into the classifying chamber 832 are moved to draw curves by the action attributable to the Coanda effect of the Coanda block 826 and the action of gases, such as concurrently inflowing air, and are classified according to the particle size and inertia force of the individual particles in such a way that larger particles (coarse particles) are classified to the outside of the gas streams, i.e., the first division on the outer side of the classifying edge 818, median particles are classified to the second division defined between the classifying edges 818 and 817, and smaller particles are classified to the third division at the inner side of the classifying edge 817. The larger particles separated by classification, the median particles separated by classification, and the smaller particles separated by classification are discharged from the discharge outlets 811, 812, and 813, respectively.

Incidentally, toner coarse powder prepared as a result of the classification in the classification step is again returned to the pulverization step and pulverized. Toner fine powder generated as a result of the classification in the classification step is again returned to the pulverization step and is pulverized. Toner fine powder generated in the classification step is returned to the step of compounding the toner raw materials so as to be utilized again. This is preferable in view of toner productivity.

The toner in the present invention may be one composed of only the toner particles obtained as described above or may be one composed of the toner particles thus obtained and with which the external additive(s) as described previously has or have optionally been mixed by external addition. As a method for treating the toner particles by external addition of the external additive(s), it is preferable that the classified toner particles and any known various kinds of external additive(s) be formulated in stated quantities and then agitated and mixed using, as an external-addition machine, a high-speed agitator, such as a Henschel mixer or a Super mixer, which applies a shear force to powders. In this external addition, since heat is generated inside the external-addition machine facilitating the formation of agglomerates, the temperature may be controlled by a means that cools with water the surroundings of a container portion of the external-addition machine. This is preferable in view of toner productivity.

EXAMPLES

The present invention is described below in greater detail by providing Examples and Comparative Examples.

| | (by weight) |
|---|---|
| Unsaturated polyester resin (unsaturated polyester resin composed of polyoxypropylene(2.2)-2,2-bis(4-hydroxyphenyl)propane, polyoxyethylene(2.2)-2,2-bis(4-hydroxyphenyl)propane, terephthalic acid, trimellitic anhydride and fumaric acid; weight-average molecular weight: 17,000; Tg: 60° C.) | 100 parts |
| Copper phthalocyanine pigment (C.I. Pigment Blue 15:3) | 6 parts |
| Paraffin wax (maximum endothermic peak temperature: 73° C.) | 5 parts |
| Charge control agent (aluminum complex of 3,5-di-tert-butylsalicylic acid) | 2 parts |

The above materials were mixed well using a Henschel mixer (FM-75 Model, manufactured by Mitsui Miike Engineering Corporation). Thereafter, the mixture obtained was kneaded by means of a twin-screw kneader (PCM-30 Model, manufactured by Ikegai Corp.) set to a temperature of 110° C. The kneaded product obtained was cooled and then crushed (coarsely pulverized) by means of a hammer mill to a size of 1 mm or less to obtain a coarsely pulverized product for producing toner particles.

The coarsely pulverized product thus obtained was finely pulverized by means of a fine grinding machine in which an impact air grinding machine that uses a high-pressure gas (high-pressure gas pressure: 0.6 MPa; flow rate: 27 $Nm^3$/min), as shown in FIG. 5, and an air classifier Turboplex (350-ATP Model, manufactured by Hosokawa Micron Corporation), as shown in FIG. 6, were set up in a closed circuit.

The finely pulverized product obtained had a weight-average particle diameter of 5.0 μm (containing 43% by number of particles of 3.17 μm or less in particle diameter and containing 0.0% by volume of particles of 8.00 μm or more in particle diameter) and an average circularity of 0.936.

Next, using the batch-wise surface modifying apparatus shown in FIG. 1, the toner material powder particles thus obtained were treated for surface modification for 30 seconds at a dispersing rotor rotational peripheral speed of 140 m/sec while introducing 1.36 kg of the toner material powder particles each time and removing fine particles at a classifying rotor rotational peripheral speed of 90 m/sec. After the introduction of the toner material powder particles through the material powder feed opening 39 was completed, the treatment was carried out for 30 seconds. Thereafter, the product discharge valve 41 was opened to take out the product as the surface-modified particles. In making the surface modification, the minimum gap between the rectangular disks 33 provided at the top surface of the dispersing rotor 32 and the liner 34 was set to 3.0 mm. Also, the height H of the rectangular disks 33 provided at the top surface of the dispersing rotor 32 of the batch-wise surface modifying apparatus shown in FIG. 1 was set to 33.5 (mm), and the external diameter D of the dispersing rotor 32 was set to 400 (mm). Therefore, the value of α calculated from $H=\sqrt{D}\times\alpha+10.5$ was 1.15. Also, the number of the rectangular disks 33 provided at the top surface of the dispersing rotor 32 was 14. Therefore, the value of $\pi\times D/n$ was 89.7 mm.

The angle θ formed by the introduction pipe of the introduction area and the fine-powder discharge pipe of the fine-powder discharge area was 250 degrees.

The gap at the face-to-face surface portion between the classifying rotor 35 and the worktop 43 was 0.5 mm.

The blower air flow was set to 15 $m^3$/min. The temperature of the refrigerant let to run through the jacket and the cold-air temperature T1 were set to −25° C. The treatment was repeated in this state, and the apparatus was operated for 20 minutes. As a result, the temperature T2 at the rear of the classifying rotor 35 became stable at 29° C. Therefore, ΔT (T2-T1) was 54° C.

Here, the target particle size of the toner particles (surface-modified particles) to be obtained was so set that the weight-average particle diameter was 5.0±0.3 μm and the fraction of particles of 3.17 μm or less in particle diameter was 20%, where the recovery (percentage) of surface-modified toner particles when controlled to have a particle size within this range was evaluated according to the following criteria. The higher the recovery, the more preferable it is in view of the productivity of toner particles.

A: The recovery is 75% or more.

B: The recovery is 65% or more to less than 75%.

C: The recovery is 55% or more to less than 65%.

D: The recovery is less than 55%.

In this Example, surface-modified toner particles having a weight-average particle diameter of 5.2 μm and having a sharp particle size distribution, in which 12% of the particles were 3.17 μm or less in particle diameter, were obtainable at a recovery of 78%. Their average circularity was 0.958. This shows that, compared with Comparative Examples provided below, higher average circularity and recovery have been achieved. This is presumed to be due to the fact that the constitution of the members in the batch-wise surface modifying apparatus and the structure and positional relationship of the members with respect to each other have been set in an appropriate state. Consequently, this improved the modification precision in the surface modification zone around the dispersing rotor 32 and classification precision in the classification zone around the classifying rotor 35.

Further, the surface shape of the surface-modified toner particles was observed using a filed emission type scanning electron microscope (FE-SEM: S-800, manufactured by Hitachi Ltd.) and was visually observed at a magnification of 10,000 to make an evaluation according to the following criteria.

A: In a circular silhouette.

B: In a somewhat elliptic silhouette.

C: With curved surface, but irregularly shaped.

D: In a rectangular silhouette.

After the operation of the surface modifying apparatus was completed, a visual observation was conducted according to the following criteria to determine whether there was any wear and particle melt adhesion on the rectangular disks 33 on the dispersing rotor 32 and the liner 34, which are surface modifying members in the apparatus.

A: Nether wear nor melt adhesion is seen.

B: Wear and melt adhesion are slightly seen.

C: Wear and melt adhesion are somewhat seen.

D: Wear and melt adhesion are conspicuously seen.

Next, based on 100 parts by weight of the toner particles obtained, 1.8 parts by weight of hydrophobic fine silica powder having a specific surface area of 200 $m^2$/g as measured by the BET method was mixed therein by external addition to obtain a toner. Based on 5 parts by weight of this toner, 95 parts by weight of an acryl-coated magnetic ferrite carrier was blended therewith to obtain a two-component developer.

Using this developer and using an altered machine of a full-color copying machine CLC1000, manufactured by CANON INC. (from the fixing unit of which an oil application mechanism was detached), images were reproduced in a normal-temperature and normal-humidity environment (23° C., 60% RH). As a result, high-quality, fog-free images without a change in image density before and after running were obtained even in a 10,000-sheet run. Double-side copied images were further formed, but no offset was seen to have occurred on both the surface and the back of transfer materials. Also, images were formed on OHP sheets, where images having good transparency were obtained. Here, the transfer efficiency of the photosensitive member to transfer material (basis weight: 199 g/$m^2$) was as high as 91%.

The fog was measured by a conventional method to make an evaluation according to the following criteria.

A: Fog is less than 0.5%.

B: Fog is 0.5 or more to less than 1.5%.

C: Fog is 1.5 or more to less than 2.0%.

D: Fog is 2.0 or more.

The transfer efficiency was measured by a conventional method to make an evaluation according to the following criteria.

A: 90% or more.

B: 88% or more to less than 90%.

C: 86% or more to less than 88%.

D: 85% or less.

A like image evaluation (5,000-sheet run) was further made in a high-temperature and high-humidity environment (32.5° C., 85% RH), and good images were obtained.

Conditions for producing the surface-modified particles in this Example and the results of the evaluation are shown in Tables 1 and 2.

Example 2

The toner material powder particles obtained in Example 1 were surface-modified using the batch-wise surface modifying apparatus shown in FIG. 1. In making the surface modification, the amount of the toner material powder particles introduced, the rotational peripheral speed of the classifying rotor 35, the rotational peripheral speed of the dispersing rotor 32, and the surface modification time were set equal to those in Example 1. The minimum gap between the rectangular disks 33 provided at the top surface of the dispersing rotor 32 and the liner 34 was set to 3.0 mm. Also, the height H of the rectangular disks 33 provided at the top surface of the dispersing rotor 32 of the batch-wise surface modifying apparatus shown in FIG. 1 was set to 24.0 (mm) and the external diameter D of the dispersing rotor 32 was set to 400 (mm). Therefore, the value of $\alpha$ calculated from $H=\sqrt{D}\times\alpha+10.5$ was 0.68. Also, the number of the rectangular disks 33 provided at the top surface of the dispersing rotor 32 was 10. Therefore, the value of $\pi\times D/n$ was 125.6 (mm).

The blower air flow was set to 15 $m^3$/min. The temperature of the refrigerant let to run through the jacket and the cold-air temperature T1 were set to −25° C. The treatment was repeated in this state, and the apparatus was operated for 20 minutes. As a result, the temperature T2 at the rear of the classifying rotor 35 became stable at 30° C. Therefore, ΔT (T2-T1) was 55° C.

The surface-modified particles obtained, the surface modifying apparatus after treatment, and a developer obtained using the toner particles in the same manner as in Example 1 were evaluated in the same manner as in Example 1. Conditions for producing the toner particles and the results of the evaluation are shown in Tables 1 and 2.

Example 3

The toner material powder particles obtained in Example 1 were surface-modified using the batch-wise surface modifying apparatus shown in FIG. 1. In making the surface modification, the amount of the toner material powder particles introduced, the rotational peripheral speed of the classifying rotor 35, the rotational peripheral speed of the dispersing rotor 32, and the surface modification time were set equal to those in Example 1. The minimum gap between the rectangular disks 33 provided at the top surface of the dispersing rotor 32 and the liner 34 was set to 1.0 mm. Also, the height H of the rectangular disks 33 provided at the top surface of the dispersing rotor 32 of the batch-wise surface modifying apparatus shown in FIG. 1 was set to 24.0 (mm) and the external diameter D of the dispersing rotor 32 was set to 400 (mm). Therefore, the value of $\alpha$ calculated from $H=\sqrt{D}\times\alpha+10.5$ was 0.68. Also, the number of the rectangular disks 33 provided at the top surface of the dispersing rotor 32 was 10. Therefore, the value of $\pi\times D/n$ was 125.6 mm.

The blower air flow was set to 15 $m^3$/min. The temperature of the refrigerant let to run through the jacket and the cold-air temperature T1 were set to −25° C. The treatment was repeated in this state, and the apparatus was operated for 20 minutes. As a result, the temperature T2 at the rear of the classifying rotor 35 became stable at 30° C. Therefore, ΔT (T2-T1) was 55° C.

The surface-modified particles obtained, the surface modifying apparatus after treatment, and a developer obtained using the toner particles in the same manner as in Example 1 were evaluated in the same manner as in Example 1. Conditions for producing the toner particles and the results of the evaluation are shown in Tables 1 and 2.

Example 4

The toner material powder particles obtained in Example 1 were surface-modified using the batch-wise surface modifying apparatus shown in FIG. 1. In making the surface modification, the amount of the toner material powder particles introduced, the rotational peripheral speed of the classifying rotor 35, the rotational peripheral speed of the dispersing rotor 32, and the surface modification time were set equal to those in Example 1. The minimum gap between the rectangular disks 33 provided at the top surface of the dispersing rotor 32 and the liner 34 was set to 3.0 mm. Also, the height H of the rectangular disks 33 provided at the top surface of the dispersing rotor 32 of the batch-wise surface modifying apparatus shown in FIG. 1 was set to 33.5 (mm) and the external diameter D of the dispersing rotor 32 was set to 400 (mm). Therefore, the value of $\alpha$ calculated from $H=\sqrt{D}\times\alpha+10.5$ was 1.15. Also, the number of the rectangular disks 33 provided at the top surface of the dispersing rotor 32 was 10. Therefore, the value of $\pi\times D/n$ was 125.6 mm.

The blower air flow was set to 15 $m^3$/min. The temperature of the refrigerant let to run through the jacket and the cold-air temperature T1 were set to −25° C. The treatment was repeated in this state, and the apparatus was operated for 20 minutes. As a result, the temperature T2 at the rear of the classifying rotor 35 became stable at 38° C. Therefore, ΔT (T2-T1) was 63° C.

The surface-modified particles obtained, the surface modifying apparatus after treatment, and a developer obtained using the toner particles in the same manner as in Example 1 were evaluated in the same manner as in Example 1. Conditions for producing the toner particles and the results of the evaluation are shown in Tables 1 and 2.

Example 5

The toner material powder particles obtained in Example 1 were surface-modified using the batch-wise surface modifying apparatus shown in FIG. 1. In making the surface modification, the amount of the toner material powder particles introduced, the rotational peripheral speed of the classifying rotor 35, the rotational peripheral speed of the dispersing rotor 32, and the surface modification time were set equal to those in Example 1. The minimum gap between the rectangular disks 33 provided at the top surface of the dispersing rotor 32 and the liner 34 was set to 3.0 mm. Also, the height H of the rectangular disks 33 provided at the top surface of the dispersing rotor 32 of the batch-wise surface modifying apparatus shown in FIG. 1 was set to 53.9 (mm) and the external diameter D of the dispersing rotor 32 was set to 400 (mm). Therefore, the value of $\alpha$ calculated from $H=\sqrt{D}\times\alpha+10.5$ was 2.17. Also, the number of the rectangular disks 33 provided at the top surface of the dispersing rotor 32 was 10. Therefore, the value of $\pi\times D/n$ was 125.6 mm.

The blower air flow was set to 15 $m^3$/min. The temperature of the refrigerant let to run through the jacket and the cold-air temperature T1 were set to −25° C. The treatment was repeated in this state, and the apparatus was operated for 20 minutes. As the result, the temperature T2 at the rear of the classifying rotor 35 became stable at 43° C. Therefore, ΔT (T2-T1) was 68° C.

The surface-modified particles obtained, the surface modifying apparatus after treatment, and a developer obtained using the toner particles in the same manner as in Example 1 were evaluated in the same manner as in Example 1. Conditions for producing the toner particles and the results of the evaluation are shown in Tables 1 and 2.

Example 6

The toner material powder particles obtained in Example 1 were surface-modified using the batch-wise surface modifying apparatus shown in FIG. 1. In making the surface modification, in this Example, the amount of the toner material powder particles introduced, the rotational peripheral speed of the classifying rotor 35, the rotational peripheral speed of the dispersing rotor 32, and the surface modification time were set equal to those in Example 1. The minimum gap between the rectangular disks 33 provided at the top surface of the dispersing rotor 32 and the liner 34 was set to 3.0 mm. Also, the height H of the rectangular disks 33 provided at the top surface of the dispersing rotor 32 of the batch-wise surface modifying apparatus shown in FIG. 1 was set to 24.0 (mm) and the external diameter D of the dispersing rotor 32 was set to 400 (mm). Therefore, the value of $\alpha$ calculated from $H=\sqrt{D}\times\alpha+10.5$ was 0.68. Also, the number of the rectangular disks 33 provided at the top surface of the dispersing rotor 32 was 14. Therefore, the value of $\pi\times D/n$ was 89.7 mm.

The blower air flow was set to 15 $m^3$/min. The temperature of the refrigerant let to run through the jacket and the cold-air temperature T1 were set to −25° C. The treatment was repeated in this state, and the apparatus was operated for 20 minutes. As a result, the temperature T2 at the rear of the classifying rotor 35 became stable at 34° C. Therefore, ΔT (T2-T1) was 59° C.

The surface-modified particles obtained, the surface modifying apparatus after treatment, and a developer obtained using the toner particles in the same manner as in Example 1 were evaluated in the same manner as in Example 1. Conditions for producing the toner particles and the results of the evaluation are shown in Tables 1 and 2.

Example 7

The toner material powder particles obtained in Example 1 were surface-modified using the batch-wise surface modifying apparatus shown in FIG. 1. In making the surface modification, the amount of the toner material powder particles introduced, the rotational peripheral speed of the classifying rotor 35, the rotational peripheral speed of the dispersing rotor 32, and the surface modification time were set equal to those in Example 1. The minimum gap between the rectangular disks 33 provided at the top surface of the dispersing rotor 32 and the liner 34 was set to 3.0 mm. Also, the height H of the rectangular disks 33 provided at the top surface of the dispersing rotor 32 of the batch-wise surface modifying apparatus shown in FIG. 1 was set to 24.0 (mm) and the external diameter D of the dispersing rotor 32 was set to 400 (mm). Therefore, the value of $\alpha$ calculated from $H=\sqrt{D}\times\alpha+10.5$ was 0.68. Also, the number of the rectangular disks 33 provided at the top surface of the dispersing rotor 32 was 28. Therefore, the value of $\pi\times D/n$ was 44.9 mm.

The blower air flow was set to 15 $m^3$/min. The temperature of the refrigerant let to run through the jacket and the cold-air temperature T1 were set to −25° C. The treatment was repeated in this state, and the apparatus was operated for 20 minutes. As a result, the temperature T2 at the rear of the classifying rotor 35 became stable at 36° C. Therefore, ΔT (T2-T1) was 61° C.

The surface-modified particles obtained, the surface modifying apparatus after treatment, and a developer obtained using the toner particles in the same manner as in Example 1 were evaluated in the same manner as in Example 1. Conditions for producing the toner particles and the results of the evaluation are shown in Tables 1 and 2.

TABLE 1

| | Example | | | | | | |
|---|---|---|---|---|---|---|---|
| | 1 | 2 | 3 | 4 | 5 | 6 | 7 |
| [Pulverization/Classification Steps] | | | | | | | |
| Grinding machine: | FIG.5 | FIG.5 | FIG.5 | FIG.5 | FIG.5 | FIG.5 | FIG.5 |
| Classifier: | FIG.6 | FIG.6 | FIG.6 | FIG.6 | FIG.6 | FIG.6 | FIG.6 |
| Weight-average particle diameter (μm): | 5.0 | 5.0 | 5.0 | 5.0 | 5.0 | 5.0 | 5.0 |
| Average circularity: | 0.936 | 0.936 | 0.936 | 0.936 | 0.936 | 0.936 | 0.936 |
| [Surface Modification Step] | | | | | | | |
| Surface modifying apparatus: | FIG.1 | FIG.1 | FIG.1 | FIG.1 | FIG.1 | FIG.1 | FIG.1 |
| Liner/disk gap (mm): | 3.0 | 3.0 | 1.0 | 3.0 | 3.0 | 3.0 | 3.0 |
| Dispersing disk height H(mm)/ number n: | 33.5/14 | 24.0/10 | 24.0/10 | 33.5/10 | 53.9/10 | 24.0/14 | 24.0/28 |
| Dispersing rotor outer diameter D (mm): | 400 | 400 | 400 | 400 | 400 | 400 | 400 |
| Value of α: | 1.15 | 0.68 | 0.68 | 1.15 | 2.17 | 0.68 | 0.68 |
| π × D/n (mm): | 89.7 | 125.6 | 125.6 | 125.6 | 125.6 | 89.7 | 44.9 |
| Dispersion/classification peripheral speed (m/sec): | 140/90 | 140/90 | 140/90 | 140/90 | 140/90 | 140/90 | 140/90 |
| Air flow ($m^3$/min): | 15 | 15 | 15 | 15 | 15 | 15 | 15 |
| Amount of toner material powder particles introduced (kg): | 1.36 | 1.36 | 1.36 | 1.36 | 1.36 | 1.36 | 1.36 |
| Treatment time (sec): | 30 | 30 | 30 | 30 | 30 | 30 | 30 |
| T1/T2: | −25/29 | −25/30 | −25/30 | −25/38 | −25/43 | −25/34 | −25/36 |
| ΔT (T2 − T1) (° C.): | 54 | 55 | 55 | 63 | 68 | 59 | 61 |

TABLE 2

| | Example | | | | | | |
|---|---|---|---|---|---|---|---|
| | 1 | 2 | 3 | 4 | 5 | 6 | 7 |
| Weight-average molecular weight (μm): | 5.2 | 5.1 | 5.1 | 5.2 | 5.2 | 5.1 | 5.1 |
| Particles of 3.17 μm or less (% by number): | 12 | 15 | 14 | 15 | 15 | 16 | 15 |
| Average circularity of modified particles: | 0.958 | 0.956 | 0.955 | 0.957 | 0.955 | 0.955 | 0.956 |
| Classification yield (%): | A | B | B | B | B | A | A |
| SEM observation: | A | B | B | A | A | A | A |
| In-machine melt adhesion: | A | B | B | B | B | B | B |
| Fog: | A | B | B | B | B | A | A |
| Transfer efficiency: | A | B | B | B | B | A | A |
| Overall evaluation: | A | B | B | B | B | A | A |

Reference Example 1

The toner material powder particles obtained in Example 1 were surface-modified using the batch-wise surface modifying apparatus shown in FIG. 1. In making the surface modification, the amount of the toner material powder particles introduced, the rotational peripheral speed of the classifying rotor 35, the rotational peripheral speed of the dispersing rotor 32, and the surface modification time were set equal to those in Example 1. The minimum gap between the rectangular disks 33 provided at the top surface of the dispersing rotor 32 and the liner 34 was set to 5.0 mm. Also, the height H of the rectangular disks 33 provided at the top surface of the dispersing rotor 32 of the batch-wise surface modifying apparatus shown in FIG. 1 was set to 24.0 (mm) and the external diameter D of the dispersing rotor 32 was set to 400 (mm). Therefore, the value of α calculated from $H=\sqrt{D}\times\alpha+10.5$ was 0.68. Also, the number of the rectangular disks 33 provided at the top surface of the dispersing rotor 32 was 10. Therefore, the value of $\pi\times D/n$ was 125.6 mm.

The blower air flow was set to 15 $m^3$/min. The temperature of the refrigerant let to run through the jacket and the cold-air temperature T1 were set to −25° C. The treatment was repeated in this state, and the apparatus was operated for 20 minutes. As a result, the temperature T2 at the rear of the classifying rotor 35 came stable at 29° C. Therefore, ΔT (T2-T1) was 54° C.

The surface-modified particles obtained, the surface modifying apparatus after treatment, and a developer obtained using the toner particles in the same manner as in Example 1 were evaluated in the same manner as in Example 1. Conditions for producing the toner particles and the results of the evaluation are shown in Tables 3 and 4.

TABLE 3

| | Reference Example 1 |
|---|---|
| [Pulverization/Classification Steps] | |
| Grinding machine/classifier: | FIG.5/FIG.6 |
| Weight-average particle diameter (μm): | 5.0 |
| Average circularity: | 0.936 |
| [Surface Modification Step] | |
| Surface modifying apparatus: | FIG. 1 |
| Liner/disk gap (mm): | 5.0 |
| Dispersing disk height H (mm)/number n: | 24.0/10 |
| Dispersing rotor external diameter D (mm): | 400 |

TABLE 3-continued

| | Reference Example 1 |
|---|---|
| Value of α: | 0.68 |
| π × D/n (mm): | 125.6 |
| Dispersion/classification peripheral speed (m/sec): | 140/90 |
| Air flow ($m^3$/min): | 15 |
| Amount of toner material powder particles introduced (kg): | 1.36 |
| Treatment time (sec): | 30 |
| T1/T2: | −25/29 |
| ΔT (T2 − T1) (° C.): | 54 |

TABLE 4

| | Reference Example 1 |
|---|---|
| Weight-average particle diameter (μm): | 5.1 |
| Particles of 3.17 μm or less (% by number): | 15 |
| Average circularity of modified particles: | 0.954 |
| Classification yield (%): | C |
| SEM observation: | A |
| In-machine melt adhesion: | A |
| Fog: | B |
| Transfer efficiency: | A |
| Overall evaluation: | C |

Example 8

| | (by weight) |
|---|---|
| Binder resin (styrene-butyl acrylate-butyl maleate half ester copolymer; weight-average molecular weight: 300,000; Tg: 65° C.) | 100 parts |
| Magnetic iron oxide (average particle diameter: 0.22 μm; magnetic properties in magnetic field of 795.8 kA/m: Hc = 5.1 kA/m, σs = 85.1 $Am^2$/kg, σr = 85.1 $Am^2$/kg) | 90 parts |
| Monoazo iron complex (negative charge control agent, T-77, available from Hodogaya Chemical Co., Ltd.) | 2 parts |
| Low-molecular weight ethylene-propylene copolymer (maximum endothermic peak temperature: 120° C.) | 3 parts |

The above materials were mixed well using a Henschel mixer. Thereafter, the mixture obtained was kneaded by means of a twin-screw kneader set to a temperature of 130° C. The kneaded product obtained was cooled and then crushed (coarsely pulverized) by means of a hammer mill to a size of 2 mm or less to obtain a material powder (coarsely pulverized product) for producing toner particles.

The material powder, coarsely pulverized product thus obtained was finely pulverized by means of a fine grinding machine in which an impact air grinding machine using high-pressure gas (high-pressure gas pressure: 0.6 MPa; flow rate: 27 $Nm^3$/min), as shown in FIG. 5, and an air classifier Turboplex (350-ATP Model, manufactured by Hosokawa Micron Corporation), as shown in FIG. 6, were set up in a closed circuit, as shown in FIG. 8. The finely pulverized product obtained was classified by means of the multi-division classifier of an inertial classification system, as shown in FIG. 7, to obtain toner material powder particles having a weight-average particle diameter of 7.6 μm and in which 49% of particles had a particle diameter of 4.00 μm or less and 38% of particles had a particle diameter of 3.17 μm or less. Thereafter, using the batch-wise surface modifying apparatus shown in FIG. 1, the toner material powder particles thus obtained were treated for surface modification. The average circularity of the toner material powder particles obtained was measured to be 0.935.

In this Example, the multi-division classifier of an inertial classification system as shown in FIG. 7 was used.

Next, using the batch-wise surface modifying apparatus shown in FIG. 1, the toner material powder particles thus obtained were treated for surface modification for 30 seconds at a dispersing rotor 32 rotational peripheral speed of 140 m/sec while introducing 4.08 kg of the toner material powder particles for each time and removing fine powder and ultrafine powder at a classifying rotor 35 rotational peripheral speed of 90 m/sec. After the introduction of the toner material powder particles through the material powder feed opening 39 was completed, the treatment was carried out for 30 seconds. Thereafter, the product discharge valve 41 was opened to take out the product as the surface-modified particles. In making the surface modification, the minimum gap between the rectangular disks 33 provided at the top surface of the dispersing rotor 32 and the liner 34 was set to 3.0 mm. Also, the height H of the rectangular disks 33 provided at the top surface of the dispersing rotor 32 of the batch-wise surface modifying apparatus shown in FIG. 1 was set to 38.7 (mm) and the external diameter D of the dispersing rotor 32 was set to 600 (mm). Therefore, the value of α calculated from $H=\sqrt{D}\times\alpha+10.5$ was 1.15. Also, the number of the rectangular disks 33 provided at the top surface of the dispersing rotor 32 was 20. Therefore, the value of $\pi\times D/n$ was 94.2 mm.

The blower air flow was set to 30 $m^3$/min. The temperature of the refrigerant let to run through the jacket and the cold-air temperature T1 were set to −25° C. The treatment was repeated in this state, and the apparatus was operated for 20 minutes. As a result, the temperature T2 at the rear of the classifying rotor 35 became stable at 39° C. Therefore, ΔT (T2-T1) was 64° C.

Surface-modified particles (toner particles) having a weight-average particle diameter of 7.8 μm and having a narrow particle size distribution, with 18% of the particles having a particle diameter of 4.00 μm or less, were obtainable at a recovery of 80%. Their average circularity was 0.952.

The toner particles obtained, the surface modifying apparatus after treatment, and a developer obtained using the toner particles in the same manner as in Example 1 were evaluated in the same manner as in Example 1. Conditions for producing the toner particles and the results of the evaluation are shown in Tables 5 and 6.

Example 9

The toner material powder particles obtained in Example 1 were surface-modified using the batch-wise surface modifying apparatus shown in FIG. 1. In making the surface modification, the amount of the toner material powder particles introduced, the rotational peripheral speed of the classifying rotor 35, the rotational peripheral speed of the dispersing rotor 32, and the surface modification time were set equal to those in Example 8. The minimum gap between the rectangular disks 33 provided at the top surface of the dispersing rotor 32 and the liner 34 was set to 3.0 mm. Also, the height H of the rectangular disks 33 provided at the top surface of the dispersing rotor 32 of the batch-wise surface modifying apparatus shown in FIG. 1 was set to 63.7 (mm) and the external diameter D of the dispersing rotor 32 was set to 600 (mm). Therefore, the value of α calculated from $H=\sqrt{D}\times\alpha+10.5$ was 2.17. Also, the number of the rectangular disks 33 provided at the top surface of the dispersing rotor 32 was 20. Therefore, the value of $\pi\times D/n$ was 94.2 (mm).

The blower air flow was set to 30 $m^3$/min. The temperature of the refrigerant let to run through the jacket and the cold-air temperature T1 were set to −25° C. The treatment was repeated in this state, and the apparatus was operated for 20 minutes. As a result, the temperature T2 at the rear of the classifying rotor 35 became stable at 43° C. Therefore, ΔT (T2-T1) was 68° C.

The toner particles obtained, the surface modifying apparatus after treatment, and a developer obtained using the toner particles in the same manner as in Example 1 were evaluated in the same manner as in Example 1. Conditions for producing the toner particles and the results of the evaluation are shown in Tables 5 and 6.

TABLE 5

| | Example | |
|---|---|---|
| | 8 | 9 |
| [Pulverization/Classification Steps] | | |
| Grinding machine/classifier: | FIGS.5, 6/FIG.7 | |
| Weight-average particle diam. (μm): | 7.6 | 7.6 |
| Average circularity: | 0.935 | 0.935 |
| [Surface Modification Step] | | |
| Surface modifying apparatus: | FIG.1 | FIG.1 |
| Liner/disk gap (mm): | 3.0 | 3.0 |
| Dispersing disk height H (mm)/number n: | 38.7/20 | 63.7/20 |
| Dispersing rotor external diameter D (mm): | 600 | 600 |
| Value of α: | 1.15 | 2.17 |
| π × D/n (mm) | 94.2 | 94.2 |
| Dispersion/classification peripheral speed (m/sec): | 140/90 | 140/90 |
| Air flow ($m^3$/min): | 30 | 30 |
| Amount of toner material powder particles introduced (kg): | 4.08 | 4.08 |
| Treatment time (sec): | 30 | 30 |
| T1/T2: | −25/39 | −25/43 |
| ΔT (T2 − T1) (° C.): (° C.) | 64 | 68 |

TABLE 6

| | Example | |
|---|---|---|
| | 8 | 9 |
| Weight-average particle diam. (μm): | 7.8 | 7.8 |
| Particles of 4.00 μm or less | 18 | 15 |

TABLE 6-continued

| | Example | |
|---|---|---|
| | 8 | 9 |
| (% by number): | | |
| Average circularity of modified particles: | 0.952 | 0.950 |
| Classification yield (%): | A | A |
| SEM observation: | A | A |
| In-machine melt adhesion: | A | B |
| Fog: | A | A |
| Transfer efficiency: | A | A |
| Overall evaluation: | A | A |

Reference Example 2

The toner material powder particles obtained in Example 1 were surface-modified using the batch-wise surface modifying apparatus shown in FIG. 1. In making the surface modification, in this Reference Example, the amount of the toner material powder particles introduced, the rotational peripheral speed of the classifying rotor 35, the rotational peripheral speed of the dispersing rotor 32, and the surface modification time were set equal to those in Example 8. The minimum gap between the rectangular disks 33 provided at the top surface of the dispersing rotor 32 and the liner 34 was set to 5.0 mm. Also, the height H of the rectangular disks 33 provided at the top surface of the dispersing rotor 32 of the batch-wise surface modifying apparatus shown in FIG. 1 was set to 28.0 (mm) and the external diameter D of the dispersing rotor 32 was set to 600 (mm). Therefore, the value of $\alpha$ calculated from $H=\sqrt{D}\times\alpha+10.5$ was 0.71. Also, the number of the rectangular disks 33 provided at the top surface of the dispersing rotor 32 was 16. Therefore, the value of $\pi\times D/n$ was 117.8 mm.

The blower air flow was set to 30 $m^3$/min. The temperature of the refrigerant let to run through the jacket and the cold-air temperature T1 were set to −25° C. The treatment was repeated in this state, and the apparatus was operated for 20 minutes. As a result, the temperature T2 at the rear of the classifying rotor 35 became stable at 35° C. Therefore, ΔT (T2-T1) was 60° C.

The surface-modified particles obtained, the surface modifying apparatus after treatment, and a developer obtained using the toner particles in the same manner as in Example 1 were evaluated in the same manner as in Example 1. Conditions for producing the toner particles and the results of the evaluation are shown in Tables 7 and 8.

TABLE 7

| | Reference Example 2 |
|---|---|
| [Pulverization/Classification Steps] | |
| Grinding machine/classifier: | FIGS.5,6/FIG.7 |
| Weight-average particle diameter (μm): | 7.6 |
| Average circularity: | 0.935 |
| [Surface Modification Step] | |
| Surface modifying apparatus: | FIG. 1 |
| Liner/disk gap (mm): | 5.0 |
| Dispersing disk height H (mm)/number n: | 28.0/16 |
| Dispersing rotor external diameter D (mm): | 600 |
| Value of α: | 0.71 |
| π × D/n (mm): | 117.8 |
| Dispersion/classification peripheral speed (m/sec): | 140/90 |

TABLE 7-continued

| | Reference Example 2 |
|---|---|
| Air flow ($m^3$/min): | 30 |
| Amount of toner material powder particles introduced (kg): | 4.08 |
| Treatment time (sec): | 30 |
| T1/T2: | −25/35 |
| ΔT (T2 − T1) (° C.): | 60 |

TABLE 8

| | Reference Example 2 |
|---|---|
| Weight-average particle diameter (μm): | 7.8 |
| Particles of 3.17 μm or less (% by number): | 15 |
| Average circularity of modified particles: | 0.950 |
| Classification yield (%): | C |
| SEM observation: | A |
| In-machine melt adhesion: | A |
| Fog: | B |
| Transfer efficiency: | A |
| Overall evaluation: | C |

Comparative Example

The material powder obtained in Example 1 was finely pulverized using the air classifier shown in FIG. 8 and an impact air grinding machine (IDS-5 type, manufactured by Nippon Pneumatic MFG Co., Ltd.) and then classified using the multi-division air classifier shown in FIG. 7. Thereafter, the toner material powder particles obtained as above were surface-modified by means of the surface modifying apparatus shown in FIG. 9.

In this Comparative Example, the compressed-air pressure used in the impact air grinding machine was set to 0.60 MPa and the material powder feed rate was set to 15 kg/hr to obtain a finely pulverized product.

Next, the finely pulverized product obtained by the pulverization using the above impact air grinding machine was classified using the multi-division air classifier shown in FIG. 7 to obtain surface-modifying particles (particles to be surface-modified) having a weight-average particle diameter of 5.3 μm, in which 15% of particles had a particle diameter of 3.17 μm or less. The average circularity of the surface-modifying particles was 0.923.

Figure 9:
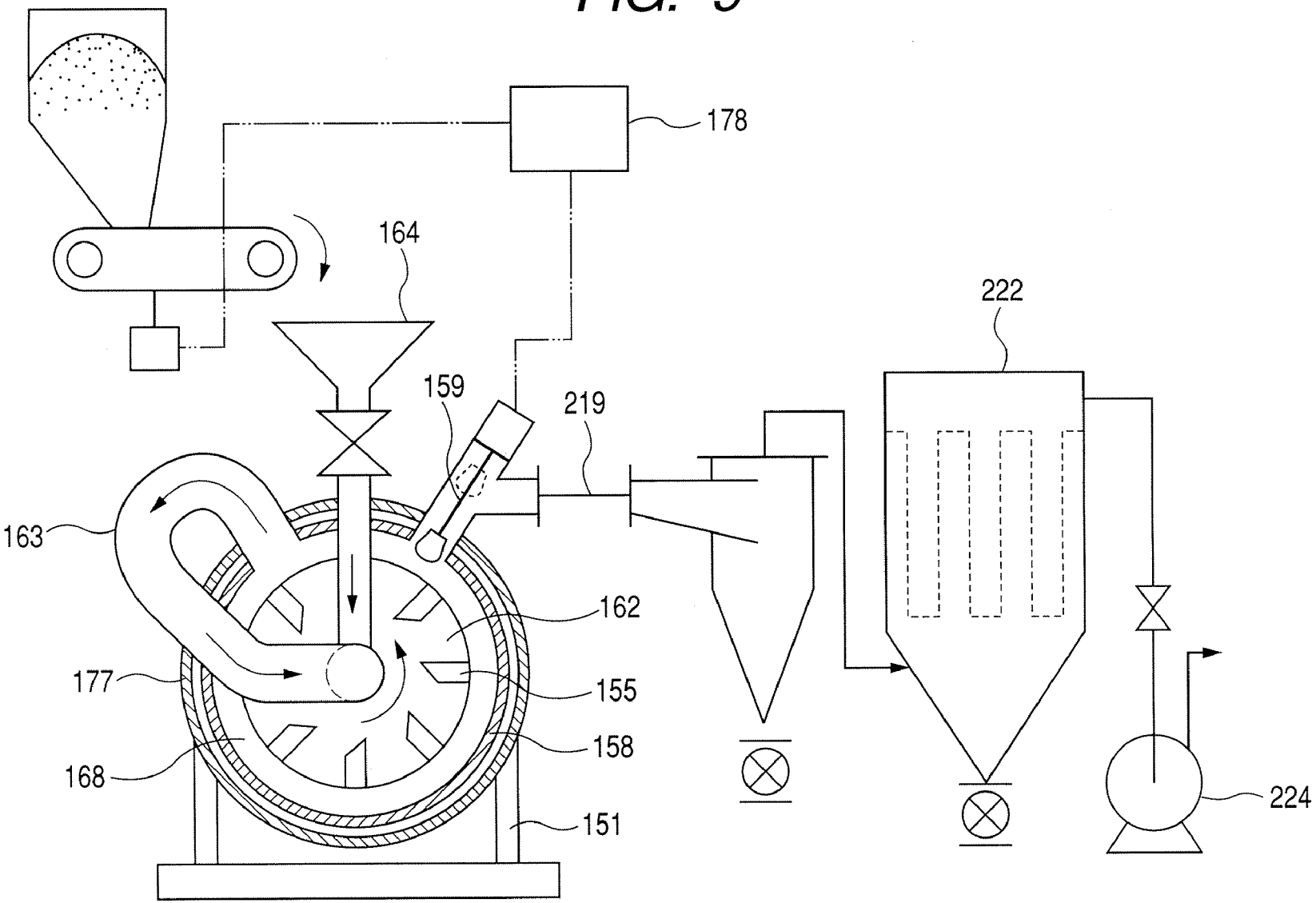
FIG. 9 is a schematic sectional view of an example of a surface modifying apparatus used in the step of surface modification of toner particles.

Next, the surface-modifying particles were led into the surface modifying apparatus shown in FIG. 9, to make a surface modification.

The surface modifying apparatus used in this Comparative Example is described below. FIG. 9 shows the surface modifying apparatus used in this Comparative Example. In FIG. 9, reference numeral 151 denotes a main-body casing; 158, a stator; 177, a stator jacket; 163, a recycle pipe; 159, a discharge valve; 219, a discharge chute; and 164, a material powder introduction chute.

In this apparatus, material powder particles and additional microscopic solid particles, both having been fed from the material powder introduction chute 164, underwent instantaneous shock action in an impact chamber 168 chiefly by means of a plurality of rotor blades 155 disposed in a rotor 162 standing rotated at a high speed, and were collided against the stator 158 provided around the rotor. This dispersed the particles inside the system while loosening the material powder particles and additional microscopic solid particles from their agglomeration, and at the same time adhered the additional microscopic solid particles to the material powder particle surfaces by an electrostatic force, van der Waals force or the like, or, in the case of the material powder particles alone, the sharpness was removed or the articles were made spherical. This state proceeded with the flying and collision of the particles. Concurrently with the flow of gas streams generated by the rotation of the rotor blades 155, the particles were treated while being passed through the recycle pipe 163 a plurality of times. The particles further underwent the shock action repeatedly from the rotor blades 155 and the stator 158, whereupon the additional microscopic solid particles were uniformly dispersed on the material powder particle surfaces or in the vicinity thereof to become fixed. In the case of the material powder particles alone, the shape of the particles remained spherical.

The particles on which the fixing of the microscopic solid particles was completed were, after the discharge valve 159 was opened by a discharge valve control unit 178, passed through the discharge chute 219 and collected by a bag filter 222 communicating with a suction blower 224.

In this Comparative Example, as the rotor 162 having the rotor blades 155, one having a maximum diameter of 242 mm was used, and the rotational peripheral speed of the rotor was set to 90 m/sec. Also, the surface-modifying particles were introduced in an amount of 300 g and the cycle time was set to 180 seconds to obtain toner particles.

The particle size distribution of the toner particles obtained was measured to find that in this Comparative Example, a weight-average particle diameter was 5.2 μm and 18% of particles had a particle diameter of 3.17 μm or less. The content of the particles with a particle diameter of 3.17 μm or less had increased compared with the particle size distribution of the material powder before surface modification. The reason why the amount of such fine powder with a particle diameter of 3.17 μm or less increased is presumed to be that the toner particles were excessively pulverized. The average circularity of the toner particles obtained was measured to find that it was 0.945. The surface shape of the toner particles was further observed on an SEM photograph. The results are shown in Table 9.

Next, the toner particles were treated by external addition and mixing in the same manner as in Example 1 to prepare a toner, which was then evaluated in the same way. As shown in Table 10, the results were inferior to those in the Examples. Also, after the operation of the surface modifying apparatus was completed, the interior of the apparatus was checked to see that some melt adhesion occurred on the rotor blades.

TABLE 9

| | Comparative Example |
|---|---|
| [Pulverization/Classification Steps] | |
| Grinding machine/classifier: | FIG.8/FIG.7 |
| Weight-average particle diameter (μm): | 5.3 |
| Particles of 3.17 μm or less (% by number): | 15 |
| Average circularity: | 0.923 |
| [Surface Modification Step] | |
| Surface modifying apparatus: | FIG.9 |
| Rotor peripheral speed (m/sec): | 90 |
| Amount of surface-modifying particles introduced (g): | 300 |
| Cycle time (sec): | 180 |

TABLE 10

| | Comparative Example |
|---|---|
| Weight-average particle diameter (μm): | 5.2 |
| Particles of 3.17 μm or less (% by number): | 18 |
| Average circularity of modified particles: | 0.945 |
| Classification yield (%): | C |
| SEM observation: | C |
| In-machine melt adhesion: | C |
| Fog: | C |
| Transfer efficiency: | C |
| Overall evaluation: | C |

This application claims priority from Japanese Patent Application No. 2003-434185, filed Dec. 26, 2003, which is hereby incorporated by reference herein.

What is claimed is:

1. A batch-wise surface modifying apparatus for classifying a toner particle material powder and carrying out a treatment for making toner particles spherical, the apparatus comprising:

a main-body casing;

a worktop having an open-close operability provided at a top of the main-body casing;

an introduction area through which the material powder is introduced into the main-body casing;

a classifying means having a classifying rotor by means of which fine powder and ultrafine powder having a particle diameter not larger than a stated particle diameter are continuously removed from the material powder introduced into the main-body casing;

a fine-powder discharge area through which the fine powder and ultrafine powder removed by the classifying means are discharged out of the main-body casing;

a surface modifying means having a dispersing rotor and a liner such that particles contained in a finely pulverized product, from which the fine powder and ultrafine powder have been removed, are subjected to a surface modification treatment using a mechanical impact force;

a cylindrical guide means for forming a first space and a second space in the main-body casing; and a toner particle discharge area through which the toner particles subjected to the surface modification treatment by the dispersing rotor and the liner are discharged out of the main-body casing, wherein the first space, which is provided between an inner wall of the main-body casing and an outer wall of the cylindrical guide means, is a space through which the material powder and the toner particles, which have been surface-modified, are guided to the classifying rotor, wherein the second space is a space in which the material powder, from which the fine powder and ultrafine powder have been removed, and the particles, which have been surface-modified, are treated by the dispersing rotor, wherein, in the surface modifying apparatus, the material powder introduced into the main-body casing through the introduction area is led into the first space, the fine powder and ultrafine powder having the particle diameter not larger than the stated particle diameter are removed by the classifying means and continuously discharged out of the apparatus, and the material powder, from which the fine powder and ultrafine powder have been removed, is moved to the second space and treated by the dispersing rotor and the liner to carry out the surface modification treatment of the toner particles contained in the material powder, and the material powder containing the toner particles that have been surface-modified are again circulated to the first space and the second space to repeat the classification and the surface modification treatment, to thereby obtain toner particles from which the fine powder and ultrafine powder having the particle diameter not larger than the stated particle diameter have been removed at a quantity not more than a stated quantity and which have been surface-modified, wherein the dispersing rotor has, at a top surface thereof, a plurality of rectangular disks, wherein the dispersing rotor has an outer diameter of 120 mm or more, wherein a minimum gap between the dispersing rotor and the liner is from 1.0 mm to 3.0 mm, and wherein a number n of the rectangular disks provided at the top surface of the dispersing rotor and an external diameter D of the dispersing rotor satisfy a relationship of expression (1):

$$\pi \times D/n < 95.0 \text{ (mm)} \quad (1).$$

2. The surface modifying apparatus according to claim 1, wherein, where a height of each disk provided at the top surface of said dispersing rotor is represented by H, and the external diameter of said dispersing rotor by D, a value of α calculated from expression (2) satisfies a relationship of expression (3):

$$H = \sqrt{D} \times \alpha + 10.5 \quad (2),$$

$$1.15 < \alpha < 2.17 \quad (3).$$

3. The surface modifying apparatus according to claim 1, wherein said introduction area is formed at a sidewall of said main-body casing, said fine-powder discharge area is formed at the top of said main-body casing, and, where in a top projection view of said surface modifying apparatus a straight line extending from central position S1 of an introduction pipe of said introduction area in a direction of introduction of said finely pulverized product into said first space is represented by L1, and a straight line extending from central position O1 of a fine-powder discharge pipe of said fine-powder discharge area in a direction of discharge of the fine powder and ultrafine powder by L2, an angle θ formed by the straight line L1 and the straight line L2 is from 210 to 330 degrees based on a rotational direction of said classifying rotor.

* * * * *